US008073365B2

(12) United States Patent
Adachi et al.

(10) Patent No.: US 8,073,365 B2
(45) Date of Patent: Dec. 6, 2011

(54) ION GENERATING DEVICE, CHARGING DEVICE, AND IMAGE FORMING APPARATUS

(75) Inventors: Katsumi Adachi, Osaka (JP); Shoutaro Okamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 210 days.

(21) Appl. No.: 12/641,776

(22) Filed: Dec. 18, 2009

(65) Prior Publication Data

US 2010/0158582 A1 Jun. 24, 2010

(30) Foreign Application Priority Data

Dec. 22, 2008 (JP) ..... 2008-326342

(51) Int. Cl.

| | |
|---|---|
| ***G03G 15/01*** | (2006.01) |
| ***G03G 15/02*** | (2006.01) |
| ***G03G 15/16*** | (2006.01) |
| ***G03G 15/20*** | (2006.01) |

(52) U.S. Cl. ..... 399/168; 399/296; 399/302; 399/308; 399/310

(58) Field of Classification Search ..... 399/168, 399/296, 302, 308, 310

See application file for complete search history.

(56) References Cited

U.S. PATENT DOCUMENTS

| | | | | |
|---|---|---|---|---|
| 5,367,366 | A | 11/1994 | Kido et al. | |
| 5,983,060 | A | 11/1999 | Namekata et al. | |
| 2009/0001280 | A1* | 1/2009 | Adachi | 250/423 R |
| 2009/0003859 | A1* | 1/2009 | Kagawa et al. | 399/50 |

FOREIGN PATENT DOCUMENTS

| | | | |
|---|---|---|---|
| JP | 63-159882 | | 7/1988 |
| JP | 64-080974 | A | 3/1989 |
| JP | 05-278258 | | 10/1993 |
| JP | 8-133708 | A | 5/1996 |
| JP | 09-305001 | | 11/1997 |
| JP | 9-305001 | A | 11/1997 |
| JP | 9-307205 | A | 11/1997 |
| JP | 10-198124 | A | 7/1998 |
| JP | 11-072990 | | 3/1999 |
| JP | 11-194581 | A | 7/1999 |
| JP | 2002-217603 | A | 8/2002 |
| JP | 2002-237368 | | 8/2002 |
| JP | 2003-249327 | | 9/2003 |
| JP | 2004-069860 | | 3/2004 |
| JP | 2004-157447 | | 6/2004 |

* cited by examiner

*Primary Examiner* — David Gray
*Assistant Examiner* — Joseph Wong
(74) *Attorney, Agent, or Firm* — Nixon & Vanderhye P.C.

(57) ABSTRACT

An ion generating device is arranged such that a heater electrode is wired so as to heat (i) a creeping discharge area and (ii) areas where respective terminal sections of an induction electrode, a discharge electrode, and the heater electrode are provided. This allows prevention of dew condensation and nitric acid generation in the vicinities of the respective terminal sections.

10 Claims, 11 Drawing Sheets

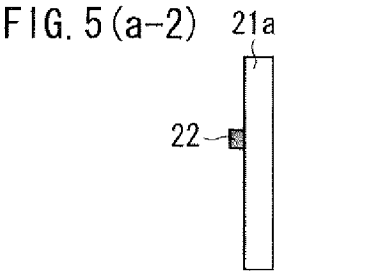
FIG. 5 (a-2)
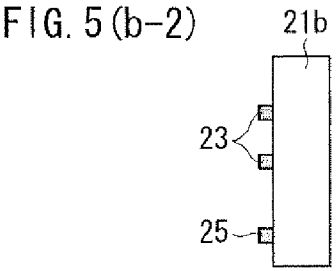
FIG. 5 (b-2)
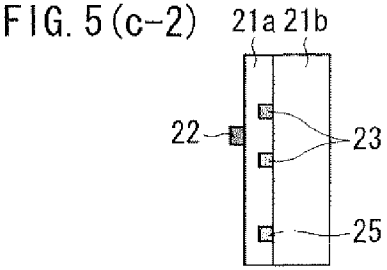
FIG. 5 (c-2)
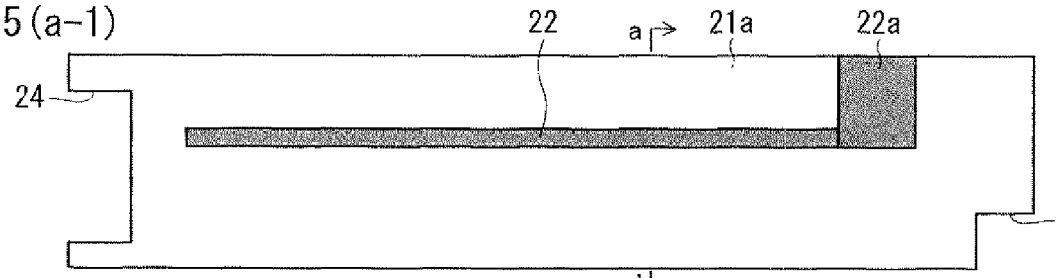
FIG. 5 (a-1)
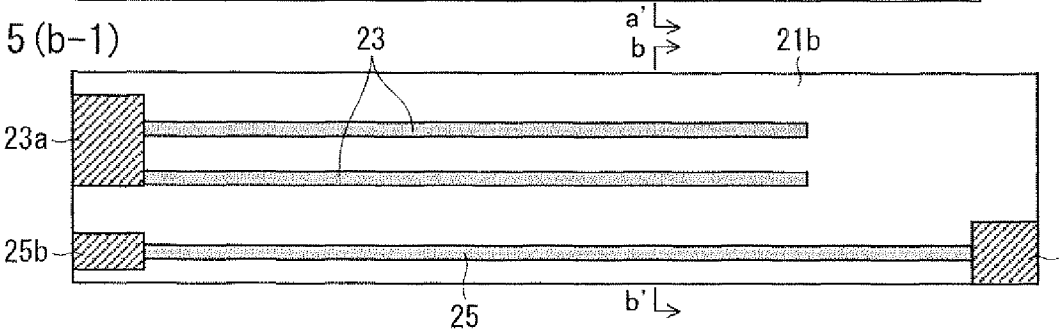
FIG. 5 (b-1)
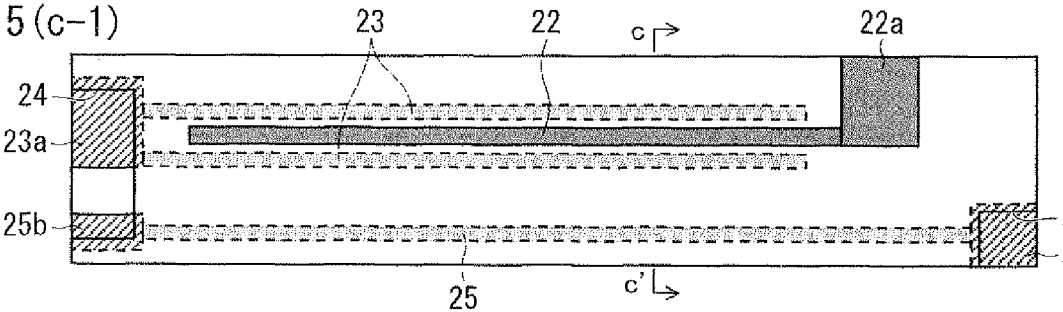
FIG. 5 (c-1)
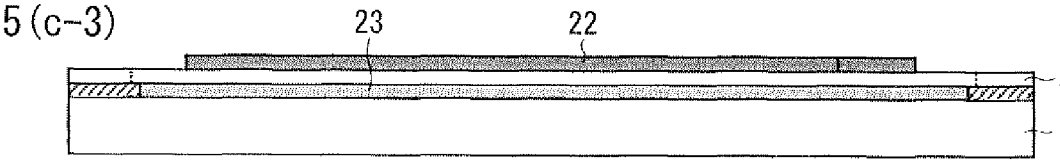
FIG. 5 (c-3)

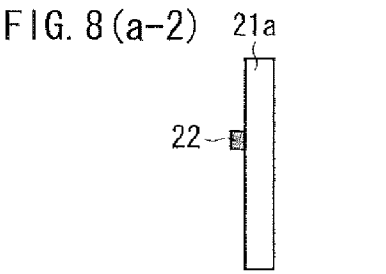
FIG. 8 (a-2)
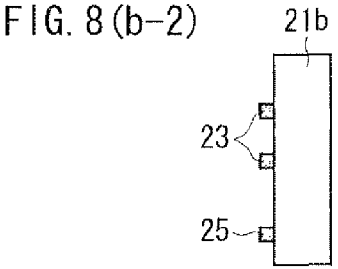
FIG. 8 (b-2)
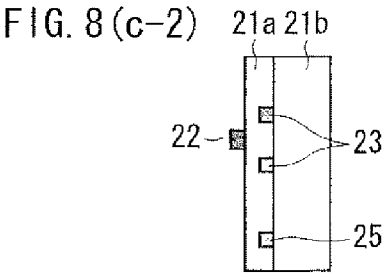
FIG. 8 (c-2)
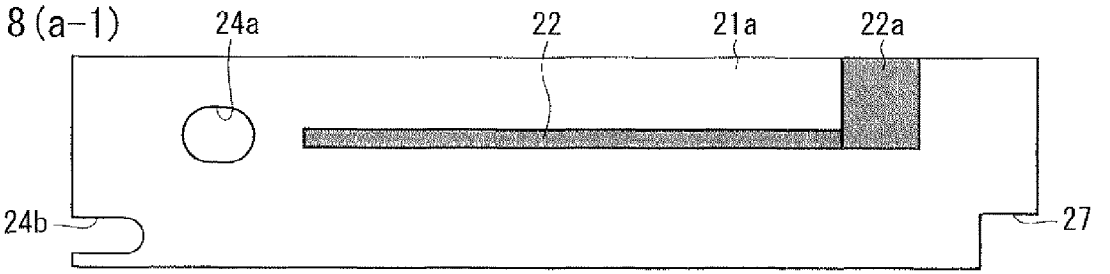
FIG. 8 (a-1)
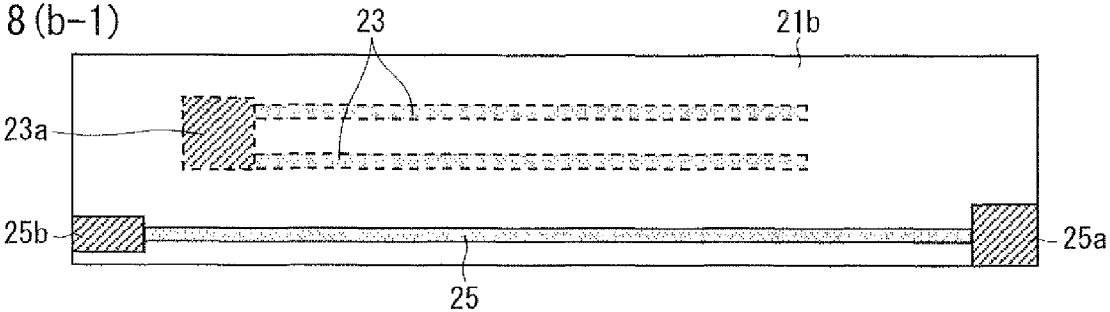
FIG. 8 (b-1)
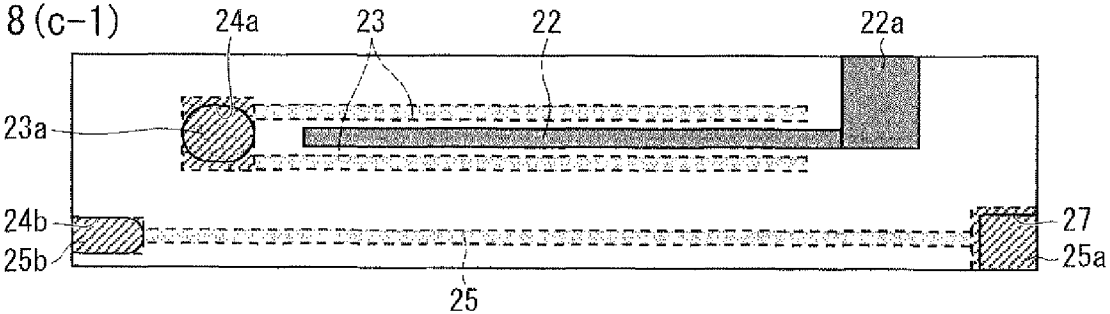
FIG. 8 (c-1)
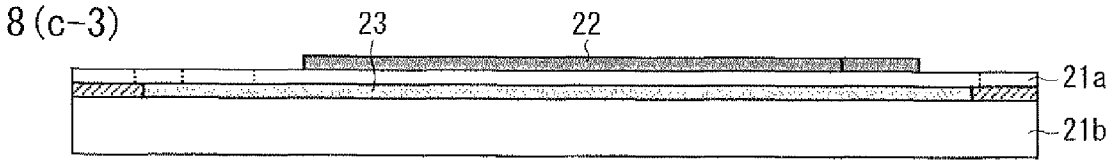
FIG. 8 (c-3)

FIG. 10(a-1)
FIG. 10(a-2)
FIG. 10(b-1)
FIG. 10(b-2)
FIG. 10(c-1)
FIG. 10(c-2)
HIGH VOLTAGE POWER SUPPLY
HEATER POWER SUPPLY
32
34
60
61
62
22
22a
23
23a
21a
21b
25a
25b
26a
26b
26c
a
a'
b
b'
c
c'

ION GENERATING DEVICE, CHARGING DEVICE, AND IMAGE FORMING APPARATUS

This Nonprovisional application claims priority under 35 U.S.C. §119(a) on Patent Application No. 2008-326342 filed in Japan on Dec. 22, 2008, the entire contents of which are hereby incorporated by reference.

TECHNICAL FIELD

The present invention relates to an ion generating device, for use in an image forming apparatus such as a copying machine, a printer, or a facsimile, which is used during an image forming process in which (i) an electrostatic latent image formed on an image bearing member is developed by toner, and then (ii) the developed electrostatic latent image is transferred to and fixed onto a print medium. The present invention also relates to; a charging device including the ion generating device; and an image forming apparatus including the charging device.

More specifically, the present invention relates to an ion generating device, in which a discharge electrode and an induction electrode are provided on front and back sides, respectively, of a dielectric member, an alternating high-voltage is applied across the discharge electrode and the induction electrode so as to cause creeping discharge and so as to cause generated ions having a desired polarity to (i) charge a charge receiving body (such as a photoreceptor) (ii) charge a toner image on image bearing members (such as the photoreceptor and an intermediate transfer member) before the toner image is transferred to transfer receiving materials (such as the intermediate transfer member and recording paper). The present invention also relates to a charging device including the ion generating device, and relates to an image forming apparatus including the charging device.

BACKGROUND ART

In a conventional image forming apparatus employing an electrophotographic printing method, a charging device employing a corona discharge system has been frequently used as: a charging device for charging a photoreceptor; a transfer device for electrostatically transferring, to recording paper or the like, a toner image which is formed on the photoreceptor or the like; and a separation device for separating the recording paper or the like which is electrostatically in contact with the photoreceptor or the like.

Such a charging device employing the corona discharge system generally includes a shield case having an opening section which faces a charge receiving materials such as the photoreceptor and the recording paper, and a discharge electrode of a line or saw-tooth shape which discharge electrode is tensed in the shield case. Examples of this charging device include: (i) a corotron charger which uniformly charges charge receiving materials by applying a high voltage to the discharge electrode so as to cause corona discharge, and (ii) a scorotron charger (refer to Patent Literature 1) which uniformly charges charge receiving materials by applying a desired voltage to a grid electrode provided between a discharge electrode and the respective charge receiving materials.

Patent Literatures 2 and 3 disclose that the charging device employing the corona discharge system is used in a charging device for charging before a transfer in which a toner image is charged before the toner image is transferred to transfer mediums such as the intermediate transfer member and the recording paper. According to techniques disclosed in Patent Documents 2 and 3, even if a charge amount is not uniform in a toner image formed on an image bearing member, the charge amount of the toner image is uniformized before the toner image is transferred. This allows (i) suppression of a decrease in transfer margin required for transferring a toner image and (ii) a stable transfer of the toner image to a transfer medium.

Note however that the conventional charging device as mentioned above has the following problems. First, the charging device requires not only the discharge electrode but also the shield case, the grid electrode, and the like. Further, it is necessary to secure a given distance (10 mm) between the discharge electrode and the respective charge receiving materials. This requires a large space for providing the charging device. Generally, a developing device, a first transfer device, and the like are provided around a first transfer section, and the photoreceptor, a second transfer device, and the like are provided in front of a second transfer section. Therefore, a space is small for providing the charging device for charging before a transfer. This causes a problem that it is difficult to make a layout in the conventional charging device employing the corona discharge system.

On the other hand, in recent years, a charging device employing a contact charging system has been used as a charging device for charging a photoreceptor itself. In the contact charging system, a conductive roller or a conductive brush carries out contact electrification. However, it is difficult to carry out charging without disordering the toner image by the contact charging system. Further, in case of employing the contact charging system, a contact with the photoreceptor or spark discharge generated in a micro air gap is highly likely to accelerate a deterioration in photoreceptor. This is an obstacle to a life extension of the photoreceptor and ultimately to a reduction in running cost. In view of this, a non-contact corona discharge system is to be used as the charging device for charging before a transfer.

In order to address the problems of the conventional charging device, for example, Patent Literature 4 discloses a charging device which includes an ion generating device (a creeping discharge device) employing a charging system (hereinafter, a charging system of this type is referred to as a creeping discharge system) in which: a discharge electrode having pointed protrusions on an outer periphery of the discharge electrode and an induction electrode are provided so as to sandwich a dielectric body between the discharge electrode and the induction electrode, and an alternating high-voltage is applied across the discharge electrode and the induction electrode so as to generate ions.

The charging device employing this creeping discharge system is small in size because the charging device has no shield case and no grid electrode. Moreover, it is easy to clean the charging device because the charging device has a flat discharging surface. Therefore, the charging device excels in maintenance. Furthermore, the charging device is not in contact with charge receiving materials and does not directly discharge surfaces of the respective charge receiving materials. Therefore, it is possible to minimize a deterioration in each of the charge receiving materials.

Note here that the ion generating device (creeping discharge device) tends to have a weaker discharge characteristic under a high humidity environment. In order to avoid this, for example, Patent Literatures 5, 6, 7, and 8 disclose techniques for improving discharging performance by providing the ion generating device with a heater member and by heating the device to remove absorption moisture on a discharge area. In particular, Patent Literatures 6 and 8 disclose a technique which also functions as a heater by applying a voltage to an induction electrode to generate Joule heat. According to the technique disclosed in Patent Document 6, it is possible to make the ion generating device more compact and lower in cost as compared with the technique of independently providing an additional heater device.

CITATION LIST

Patent Literature 1
Japanese Patent Application Publication, Tokukaihei, No. 6-11946 A (Publication Date: Jan. 21, 1994)
Patent Literature 2
Japanese Patent Application Publication, Tokukaihei, No. 10-274892 A (Publication Date: Oct. 13, 1998)
Patent Literature 3
Japanese Patent Application Publication, Tokukai, No. 2004-69860 A (Publication Date: Mar. 4, 2004)
Patent Literature 4
Japanese Patent Application Publication, Tokukai, No. 2003-249327 A (Publication Date: Sep. 5, 2003)
Patent Literature 5
Japanese Patent Application Publication, Tokukai, No. 2004-157447 A (Publication Date: Jun. 3, 2004)
Patent Literature 6
Japanese Patent Application Publication, Tokukai, No. 2002-237368 A (Publication Date: Aug. 23, 2002)
Patent Literature 7
Japanese Patent Application Publication, Tokukaihei, No. 9-305001 A (Publication Date: Nov. 28, 1997)
Patent Literature 8
Japanese Patent Application Publication, Tokukaihei, No. 11-72990 A (Publication Date: Mar. 16, 1999)

SUMMARY OF INVENTION

Technical Problem

However, in a case where an ion generating device has a heater electrode (heater line) as described earlier, there occur the following problems. First, FIG. 10 (*a*-1), FIG. 10 (*b*-1), and FIG. (c-1) illustrate conventional ion generating devices 60, 61, and 62, respectively. FIG. 10 (*a*-2), FIG. 10 (*b*-2), and FIG. 10 (*c*-2) are cross-sectional views taken from the lines a-a' of the ion generating device 60 in FIG. 10 (*a*-1), b-b' of the ion generating device 61 in FIG. 10 (*b*-1), and c-c' of the ion generating device 62 in FIG. (c-1), respectively. Each vicinity of discharge electrodes 22 is heated by providing the ion generating devices 60, 61, and 62 with heater electrodes 26*a*, 26*b*, and 26*c*, respectively, so that moisture which has adhered to each surface of the ion generating devices 60, 61, and 62 is removed.

The ion generating device 60 in FIG. 10 (*a*-1) and FIG. 10 (*a*-2) includes the heater electrode (a heater resistor) 26*a* which has a solid shape and is provided on a back surface of an insulating base material 21*b*. According to the ion generating device 60, a discharge area where a discharge electrode and an induction electrode are provided to face each other is heated by Joule heat generated by supplying power to the heater electrode 26*a*. This prevents moisture from adhering to a discharge part even under a high humidity environment, so that discharge is stably carried out. The ion generating device 61 shown in FIG. 10 (*b*-1) and FIG. 10 (*b*-2) includes the heater electrode 26*b* which has a line shape and is provided on a surface of the insulating base material 21*b* on which surface induction electrodes 23 are provided. According to the ion generating device 61, since a discharge area is narrowed so as to have a given resistance, it is possible to generate necessary heat. The ion generating device 62 in FIG. 10 (*c*-1) and FIG. 10 (*c*-2) includes the heater electrode 26*c* which has a wavy line shape and is provided on a surface of the insulating base material 21*b* on which surface induction electrodes 23 are provided. The ion generating device 62 has a function similar to the ion generating device 61.

However, the conventional ion generating devices 60, 61, and 62 thus arranged cause the following problems. In each of the conventional ion generating devices 60, 61, and 62, the discharge area is sufficiently heated and moisture which has adhered to the discharge area is vaporized. In contrast, since the outside of the discharge area is insufficiently heated by a heater, high-moisture and high-temperature air is cooled. This may cause dew condensation. (a) and (b) of FIG. 11 are explanatory drawings illustrating such a phenomenon. In the discharge area, ozone, whose amount is smaller than that generated from a corona discharge device, is generated. This causes an $NO_x$ gas to be generated. Dissolution of the $NO_x$ gas into the dew moisture causes nitric acid ($HNO_3$) to be generated by the following reactions.

For example, in a case where $NO_x$ is nitric oxide (NO) or nitric dioxide ($NO_2$), the following chemical reactions occur:

$$2NO+O_2 \rightarrow 2NO_2 \quad \text{(i)}$$

$$3NO_2+H_2O \rightarrow 2HNO_3+NO \text{ (NO is resubjected to the reaction (i))} \quad \text{(ii)}$$

When adhering to an electrode terminal section (a contact point section) of the ion generating device, the nitric acid ($HNO_3$) may cause corrosion of the terminal section. This ultimately causes bad conduction and/or migration. Particularly in a case where the electrode terminal section is provided in the vicinity of an end part of the device, a large amount of heat applied by the heater is lost from the device, and the device is therefore easy to have a lower temperature. This causes the problems of dew condensation and nitric acid generation to be more serious.

Furthermore, an insulating characteristic deteriorates depending on a material of a dielectric layer. In a case where the dielectric layer is made of low temperature co-fired ceramic (LTCC) or glass, nitric acid may dissolve a glass component. This causes a decline in insulating performance. Such a phenomenon will not end with a decline in performance of the device, instead can cause abnormal heat generation or ignition due to an electric leakage. Particularly in a case where the electrode terminal section is made of a comparatively low-cost material such as Ag, Cu, or Ni instead of a high-cost material such as Au or Pt, the electrode terminal section is corrosion-prone due to nitric acid. This is an obstacle to reduction in cost of the material.

In view of the circumstances, the ion generating device is required to stabilize discharging performance and to be highly resistant to the occurrence of an abnormality even if there is a change in condition for an environment where the ion generating device is used. Note that the patent literatures do not disclose the adverse effect caused by the heater function.

The present invention has been made in view of the above problems, and its object is to provide (i) an ion generating device, for generating ions in response to creeping discharge, which is low in cost, which keeps stably operating even if there is a change in environment where the ion generating device is used, and which cares for safety, (ii) a charging device, and (iii) an image forming apparatus.

Solution to Problem

In order to achieve the object, an ion generating device in accordance with the present invention, includes a discharge electrode and an induction electrode provided to face each other via a dielectric layer, the ion generating device generating ions in response to creeping discharge caused by applying an alternating voltage across the discharge electrode and the induction electrode, the induction electrode being provided in an insulating base material, a heater electrode, provided on the insulating base material, which generates, in response to electric power being supplied, Joule heat for causing the ion generating device to be heated, the heater electrode being wired so as to heat (i) a creeping discharge area where the creeping discharge occurs and (ii) areas where respective terminal sections of the induction electrode, the discharge electrode, and the heater electrode are provided.

Advantageous Effects of Invention

According to the arrangement, the heater electrode heats (i) the creeping discharge area and (ii) the areas where the respective terminal sections of the induction electrode, the discharge electrode, and the heater electrode are provided.

Note here that the ion generating device is preferably arranged such that the vicinity of the discharge electrode where the creeping discharge occurs is heated so that the ion generating device discharges more stably in a high humidity environment. Namely, it is possible to heat the vicinity of the discharge electrode and to remove moisture which has adhered to a surface of the device by providing the heater electrode of the ion generating device, so that the ion generating device can stably discharge. However, in a case where an area other than the area in which the creeping discharge occurs is insufficiently heated, there occurs a temperature difference on the surface of the device. In that case, comparatively high-temperature air containing a large amount of moisture generated in a heated area is cooled in an unheated area. This easily causes dew condensation. In the discharge area, ozone, whose amount is smaller than that generated from a corona discharge device, is generated. This causes an $NO_x$ gas to be generated. Dissolution of the $NO_x$ gas into the dew moisture causes nitric acid ($HNO_3$) to be generated. When adhering to an electrode terminal section (a contact point section) of the ion generating device, the nitric acid ($HNO_3$) may cause corrosion of the terminal section. This ultimately causes bad conduction and/or migration. Furthermore, an insulating characteristic deteriorates depending on a material of a dielectric layer. In a case where the dielectric layer is made of low temperature co-fired ceramic (LTCC) or glass, a component of nitric acid may dissolve a glass component. This causes a decline in insulating performance. Such a phenomenon will not end with a decline in performance of the device, instead can cause abnormal heat generation or ignition due to an electric leakage. Particularly in a case where the electrode terminal section is made of a comparatively low-cost material such as Ag, Cu, or Ni instead of a high-cost material such as Au or Pt, the electrode terminal section is corrosion-prone due to nitric acid. This is an obstacle to reduction in cost of the material.

In view of the circumstances, according to the arrangement of the present invention, it is possible to prevent nitric acid generation and an adverse effect on an electrode contact point without causing dew condensation as described above because the areas where the respective terminal sections of the induction electrode, the discharge electrode, and the heater electrode are provided are heated by the heater electrode. This allows stable discharge under the high humidity environment and prevents a malfunction caused by a defective contact point due to dew condensation, so that the ion generating device can function more reliably. This allows a use of a low-cost material such as Ag, Cu, or Ni as a material of the electrode terminal section and also a contribution to reduction in cost of the device itself.

As described earlier, it is possible to provide an ion generating device which is low in cost, which keeps stably functioning even if there is a change in environment where the ion generating device is used, and which cares for safety.

BRIEF DESCRIPTION OF DRAWINGS (a) of FIG. 1 is a plan view illustrating an embodiment of an ion generating device in accordance with the present invention, and (b) of FIG. 1 an explanatory drawing illustrating a temperature characteristic of the ion generating device in (a) of FIG. 1.

FIG. 2 an explanatory drawing illustrating an arrangement of a relevant part of an image forming apparatus in accordance with the present invention.

FIG. 3 (*b*) is a cross-sectional view of the ion generating device connected to power supplies.

FIG. 3 (*c*) is a plan view of the ion generating device connected to the power supplies.

FIG. 4 (*b*) illustrates an example of the ion generating device of the embodiment of the present invention.

FIG. 4 (*c*) illustrates an example of the ion generating device of the embodiment of the present invention.

FIG. 4 (*d*) illustrates an example of the ion generating device of the embodiment of the present invention.

FIG. 5 (*a*-1) is an elevational view of a dielectric layer of an ion generating device in accordance with an embodiment of the present invention.

FIG. 5 (*a*-2) is a side view of the dielectric layer of the ion generating device in accordance with the embodiment of the present invention.

FIG. 5 (*b*-1) is an elevational view of an insulating base material of the ion generating device in accordance with the embodiment of the present invention.

FIG. 5 (*b*-2) is a side view of the insulating base material of the ion generating device in accordance with the embodiment of the present invention.

FIG. 5 (*c*-1) is an elevational view of the ion generating device in accordance with the embodiment of the present invention.

FIG. 5 (*c*-2) is a transverse side view of the ion generating device in accordance with the embodiment of the present invention.

FIG. 5 (*c*-3) is a longitudinal side view of the ion generating device in accordance with the embodiment of the present invention.

FIG. 6 (*b*) illustrates a measurement system for measuring the waveform in FIG. 6 (*a*).

Figures 7A, 7B, 7C:
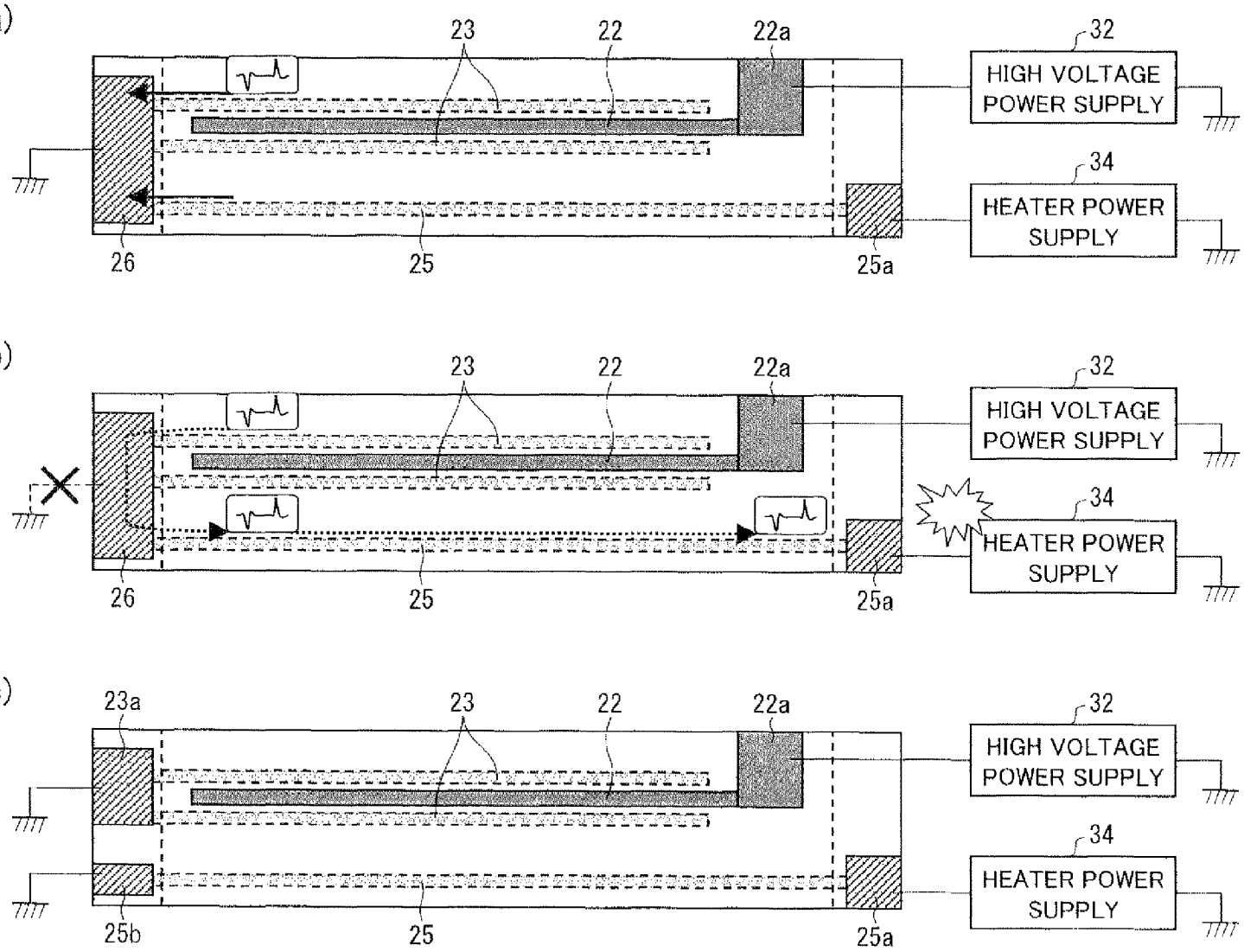
FIG. 7 (*a*) is a plan view of the ion generating device in which the induction electrode and a heater electrode are electrically connected via a common ground terminal section.

FIG. 7 (*b*) an explanatory drawing illustrating a malfunction which may occur in the ion generating device in FIG. 7 (*a*).

FIG. 7(*c*) is a plan view of the ion generating device in FIG. 7 (*a*) in which the induction electrode and the heater electrode of the ion generating device are insulated from each other.

FIG. 8 (*a*-1) is an elevational view of a dielectric layer of a modification of the ion generating device in accordance with the embodiment of the present invention.

FIG. 8 (*a*-2) is a side view of the dielectric layer of the modification of the ion generating device.

FIG. 8 (*b*-1) is an elevational view of an insulating base material of the modification of the ion generating device.

FIG. 8 (*b*-2) is a side view of the insulating base material of the modification of the ion generating device.

FIG. 8 (*c*-1) is an elevational view of the modification of the ion generating device.

FIG. 8 (*c*-2) is a transverse side view of the modification of the ion generating device.

FIG. 8 (*c*-3) is a longitudinal side view of the modification of the ion generating device.

Figure 9:
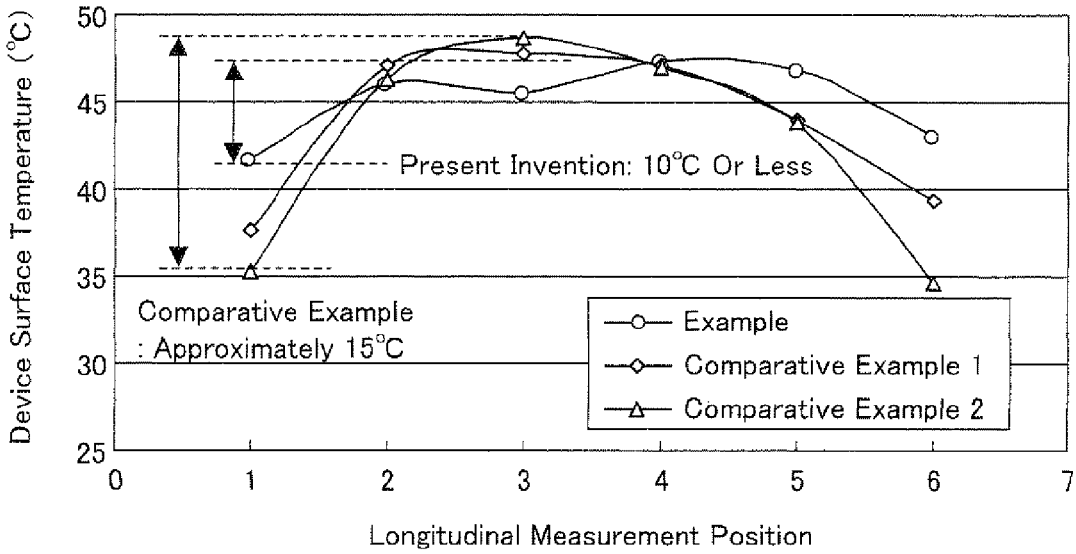
Figure 9:
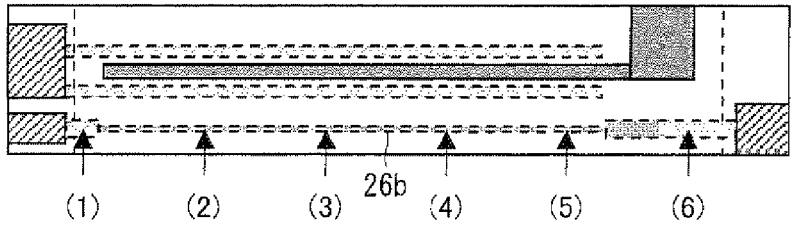
Figure 9:
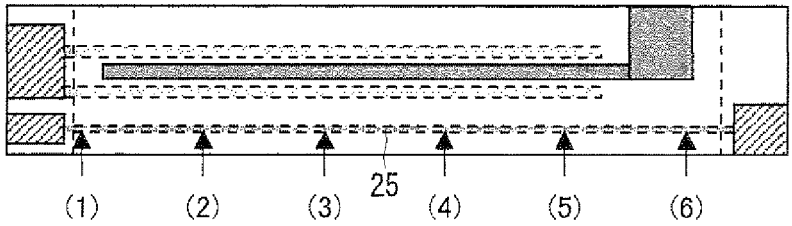

FIG. 9 (*a*) is a graph illustrating (i) a temperature measurement result of the ion generating device in accordance with the present invention which is an example and (ii) a temperature measurement result of a conventional ion generating device which is a comparative example.

FIG. 9 (*b*) illustrates how the ion generating device of the comparative example is arranged and where it was subjected to the temperature measurement.

FIG. 9 (*c*) illustrates how the ion generating device of the example is arranged and where it was subjected to the temperature measurement.

Figure 10:
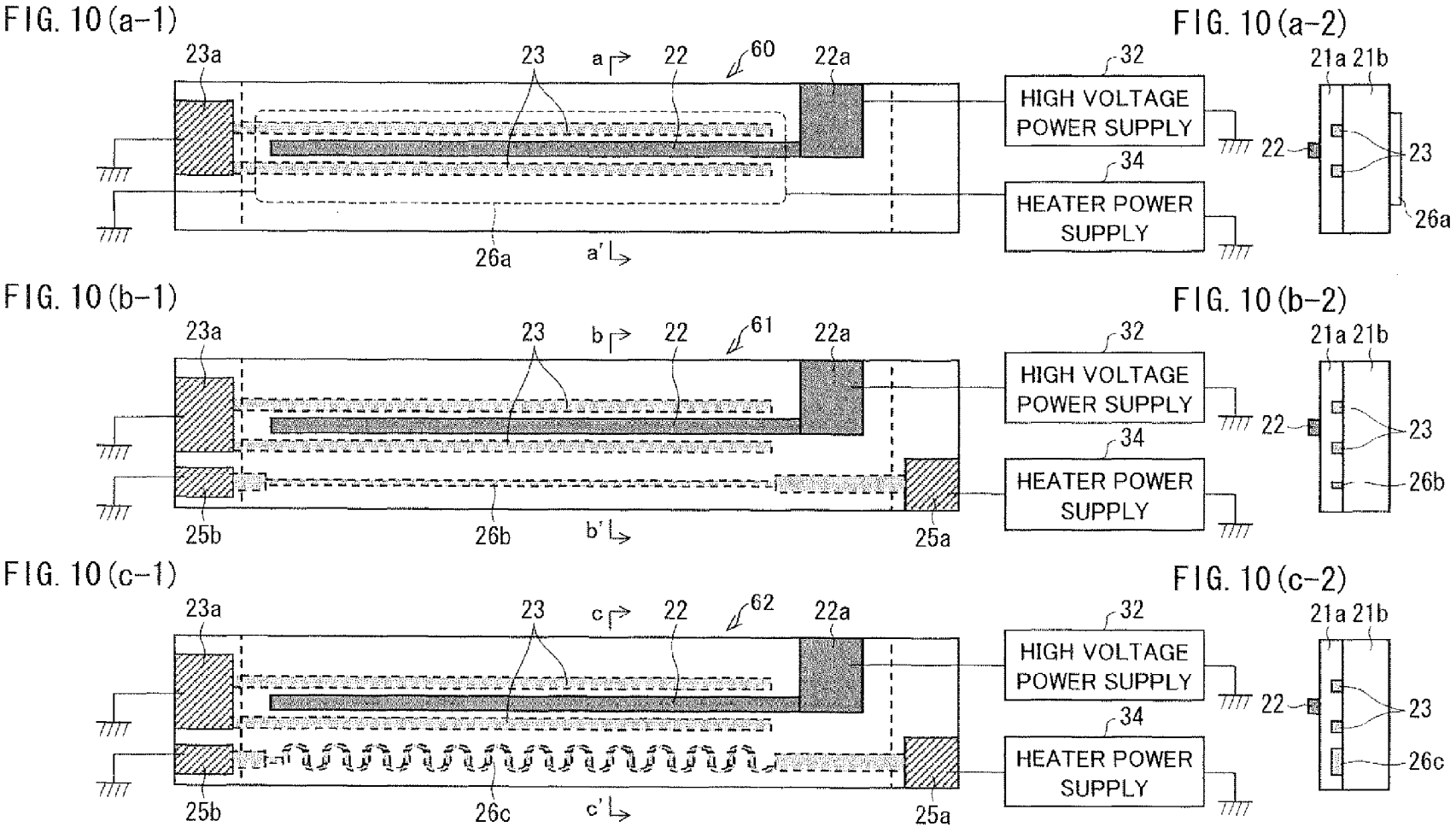

FIG. 10 (*a*-1) is a plan view of the conventional ion generating device.

FIG. 10 (*a*-2) is a cross-sectional view of the ion generating device in FIG. 10 (*a*-1).

FIG. 10 (*b*-1) is a plan view illustrating another conventional ion generating device.

FIG. 10 (*b*-2) is a cross-sectional view illustrating the ion generating device in FIG. 10 (*b*-1).

FIG. 10 (*c*-1) is a plan view illustrating still another conventional ion generating device.

FIG. 10 (*c*-2) is a cross-sectional view illustrating the ion generating device in FIG. 10 (*c*-1).

Figure 11:
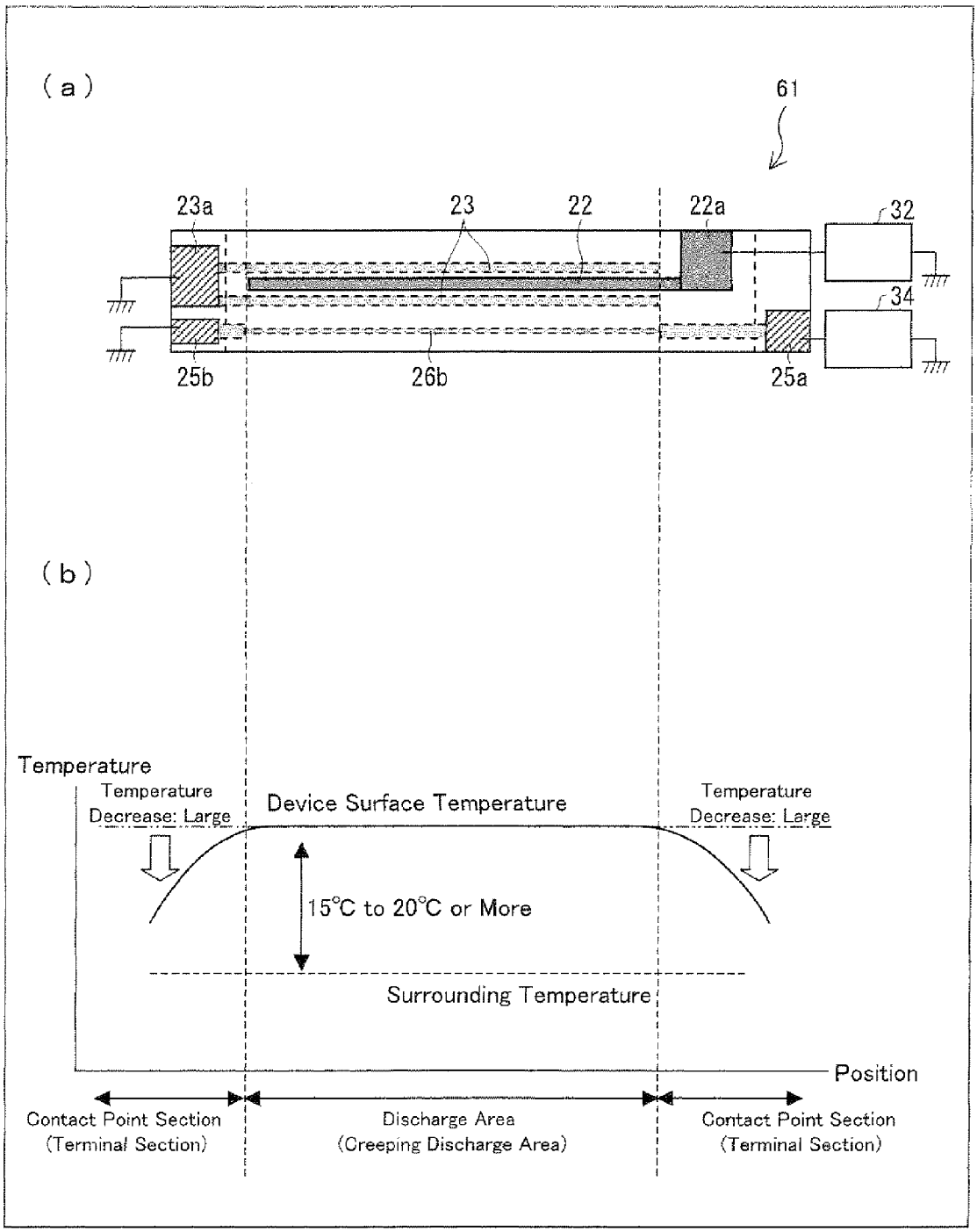

(a) of FIG. 11 is a plan view illustrating the conventional ion generating device, and (b) of FIG. 11 is an explanatory drawing illustrating a temperature characteristic of the ion generating device in (a) of FIG. 11.

DESCRIPTION OF EMBODIMENTS

Embodiment

The following describes in detail an embodiment of an ion generating device in accordance with the present invention, a charging device including the ion generating device, and an image forming apparatus including the charging device with reference to FIGS. 1 through 9 (*c*). Note that the technical scope of the present invention is not limited to the following embodiment, which is an example that embodies the present invention.

(Whole Arrangement of Image Forming Apparatus)

Figure 2:
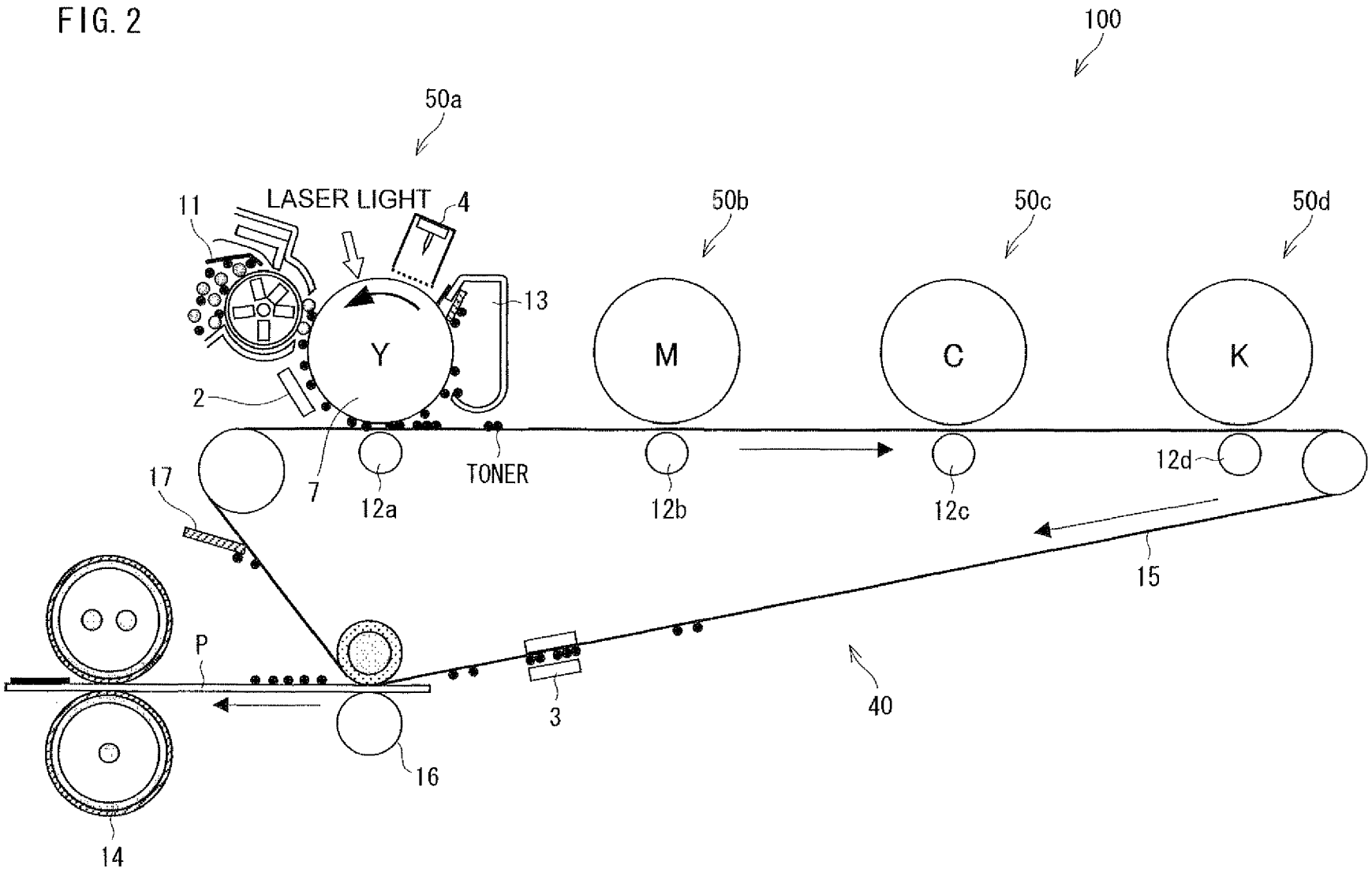

First, the following describes a whole arrangement of an image forming apparatus in accordance with the present embodiment. FIG. 2 is a cross-sectional view schematically illustrating an arrangement of an image forming apparatus 100 including a charging device for charging before a transfer in accordance with the present embodiment. The image forming apparatus 100 is a tandem type printer employing an intermediate transfer system, and can form a full-color image.

The image forming apparatus 100 includes visible image forming units 50*a* through 50*d* for four colors (C, M, Y, and K), a transfer unit 40, and a fixing device 14 (see FIG. 2).

The transfer unit 40 includes an intermediate transfer belt 15 (an image bearing member), four first transfer devices 12*a* through 12*d* provided around the intermediate transfer belt 15, a charging device 3 for charging before a second transfer, a second transfer device 16, and a transfer cleaning device 17.

Toner images of the colors which toner images are visualized by the respective visible image forming units 50*a* through 50*d* are overlapped on and transferred to the intermediate transfer belt 15. The intermediate transfer belt 15 retransfers to recording paper P the toner images that has been transferred. Specifically, the intermediate transfer belt 15 is an endless belt, and is provided in a tensioned state by a pair of drive rollers and an idle roller. While an image is being formed, the intermediate transfer belt 15 is subjected to carrying and driving at a given peripheral velocity (in a range of 167 mm/s to 225 mm/s in the present embodiment).

The first transfer devices 12*a* through 12*d* are provided for the visible image forming units 50*a* through 50*d*, respectively. A bias voltage whose polarity is reverse to that of a toner image formed on a surface of a corresponding photoreceptor drum 7 is applied to a corresponding one of the first transfer devices 12*a* through 12*d*. This causes the toner image to be transferred to the intermediate transfer belt 15. The first transfer devices 12*a* through 12*d* are provided so as to face the visible image forming units 50*a* through 50*d*, respectively, via the intermediate transfer belt 15.

The charging device 3 for charging before a second transfer recharges the toner image which has been overlapped on and transferred to the intermediate transfer belt 15. In the present embodiment, the charging device 3 for charging before a second transfer emits ions so as to charge the toner image (later described in detail).

The second transfer device 16 retransfers, to the recording paper P, the toner image which has been transferred to the intermediate transfer belt 15. The second transfer device 16 is provided so as to be in contact with the intermediate transfer belt 15. The transfer cleaning device 17 cleans a surface of the intermediate transfer belt 15 which has been subjected to a retransfer of the toner image.

Around the intermediate transfer belt 15 of the transfer unit 40, the first transfer units 12*a* through 12*d*, the charging device 3 for charging before a second transfer, the second transfer device 16, and the transfer cleaning device 17 are provided in this order from upstream of a carrying direction of the intermediate transfer belt 15.

The fixing device 14 is provided downstream of the second transfer device 16 in a carrying direction of the recording paper P. The fixing device 14 fixes, onto the recording paper P, the toner image which has been transferred onto the recording paper P by the second transfer device 16.

Furthermore, the four visible image forming units 50*a* through 50*d* are provided so as to be in contact with the intermediate transfer belt 15 in the carrying direction of the intermediate transfer belt 15. The four visible image forming units 50*a* through 50*d* have an identical arrangement, except that different toner colors are used. The toner colors of the four visible image forming units 50*a* through 50*d* are yellow (Y), magenta (M), cyan (C), and black (K), respectively. The following describes only the visible image forming unit 50*a*, and omits explanations of the other visible image forming units 50*b* through 50*d*. Accordingly, FIG. 2 illustrates only members of the visible image forming unit 50*a*. However, each of the other visible image forming units 50*b* through 50*d* also includes members identical to those of the visible image forming unit 50*a*.

The visible image forming unit 50*a* includes the photoreceptor drum (image bearing member) 7, and further includes members, such as a latent image charging device 4, a laser writing unit (not illustrated), a developing device 11, a charging device 2 for charging before a first transfer, and a cleaning device 13, which are provided around the photoreceptor drum 7.

The surface of the photoreceptor drum 7 is charged by the latent image charging device 4 so as to have a given electric potential. The latent image charging device 4 will be later described in detail. In the present embodiment, the photoreceptor drum 7 is charged by ions emitted from the latent image charging device 4.

The laser writing unit directs a laser beam toward the photoreceptor drum 7 (exposes the photoreceptor drum 7 to the laser beam), and scans the photoreceptor drum 7 in accordance with image data received from an external device so as to obtain a light image. This causes formation of an electrostatic latent image on the photoreceptor drum 7 which has been uniformly charged.

The developing device 11 supplies toner to the electrostatic latent image formed on the surface of the photoreceptor drum 7 so as to make the electrostatic latent image visible. The toner image is thus formed on the photoreceptor drum 7.

The charging device 2 for charging before a first transfer recharges the toner image formed on the surface of the photoreceptor drum 7 before the toner image is transferred (later described in detail). In the present embodiment, the toner image is charged by ions emitted from the charging device 2 for charging before a first transfer.

The cleaning device 13 removes and collects residual toner and the like which are left on the photoreceptor drum 7 from which the toner image has been transferred to the intermediate transfer belt 15. This causes a new electrostatic latent image and a new toner image to be recorded on the photoreceptor drum 7.

Around the photoreceptor drum 7 of the visible image forming unit 50*a*, the latent image charging device 4, the laser writing unit, the developing device 11, the charging device 2 for charging before a first transfer, the first transfer device 12*a*, and the cleaning device 13 are provided in this order from upstream of a rotation direction of the photoreceptor drum 7.

Next, the following describes image forming operation of the image forming apparatus 100. Operation of the visible image forming unit is described with reference to members (those having reference numerals) of the visible image forming unit 50*a*. Note that each of the visible image forming units 50*b* through 50*d* carries out an operation similar to the visible image forming unit 50*a*.

First, the image forming apparatus 100 obtains image data from the external device (not illustrated). Moreover, a drive unit (not illustrated) of the image forming apparatus 100 causes the photoreceptor drum 7 to rotate, in a direction shown by an arrow illustrated in FIG. 2, at a given velocity (in a range of 167 mm/s to 225 mm/s, in the present embodiment). Concurrently, the latent image charging device 4 causes the surface of the photoreceptor drum 7 to be charged by a given electric potential.

Next, the laser writing unit exposes the surface of the photoreceptor drum 7 in accordance with the image data obtained from the external device, and forms an electrostatic latent image on the surface of the photoreceptor drum 7 in accordance with the image data. Subsequently, the developing device 11 supplies toner to the electrostatic latent image formed on the surface of the photoreceptor drum 7. This causes the toner to adhere to the electrostatic latent image, thereby forming a toner image.

Thereafter, the charging device 2 for charging before a first transfer recharges the toner image formed on the surface of the photoreceptor drum 7. Then, the bias voltage whose polarity is reverse to that of the toner image formed on the surface of the photoreceptor drum 7 is applied to the first transfer device 12*a*. The first transfer device 12*a* transfers, to the intermediate transfer belt 15, the toner image recharged by the charging device 2 for charging before a first transfer (this transfer is referred to as a first transfer).

The visible image forming units 50*a* through 50*d* carry out the operation in order. This causes the toner images of the four colors Y, M, C, and K to overlap each other, in order, on the intermediate transfer belt 15.

The toner images that have been overlapped are carried to the charging device 3 for charging before a second transfer by the intermediate transfer belt 15, and is then recharged by the charging device 3 for charging before a second transfer. Then, the second transfer device 16 presses the intermediate transfer belt 15 which bears the toner images recharged by the charging device 3 against the recording paper P fed by a paper feeding unit (not illustrated). This causes a voltage whose polarity is reverse to that of toner charge to be applied to the second transfer device 16, thereby transferring the toner images to the recording paper P (this transfer is referred to as a second transfer).

Then, the fixing device 14 fixes the toner image onto the recording paper P. The recording paper P onto which the image has been fixed is outputted to a paper output unit (not illustrated). After the second transfer, residual toner on the photoreceptor drum 7 is removed and collected by the cleaning device 13. Further, residual toner on the intermediate transfer belt 15 is removed and collected by the transfer cleaning device 17. The above operations allow the image forming apparatus 100 to appropriately print an image on the recording paper P.

(Arrangement of Charging Device for Charging Before a Transfer)

The following describes in detail an arrangement of the charging device before a transfer. The charging device 2 for charging before a first transfer, the latent image charging device 4, and the charging device 3 for charging before a second transfer which are described earlier are provided in different places, but have an identical arrangement. In the latent image charging device 4, a grid electrode for controlling a charging electric potential can be provided between an ion generating device (a creeping discharge device) 1 described below and the photoreceptor drum 7. For example, it is preferable that this grid electrode be provided so as to be approximately 1 mm or so away from the photoreceptor drum 7, and 2 mm to 10 mm or so away from the ion generating device 1. The following describes in detail the charging device 3 for charging before a second transfer, but omits detail descriptions of the charging device 2 for charging before a first transfer and the latent image charging device 4.

Figure 3A:
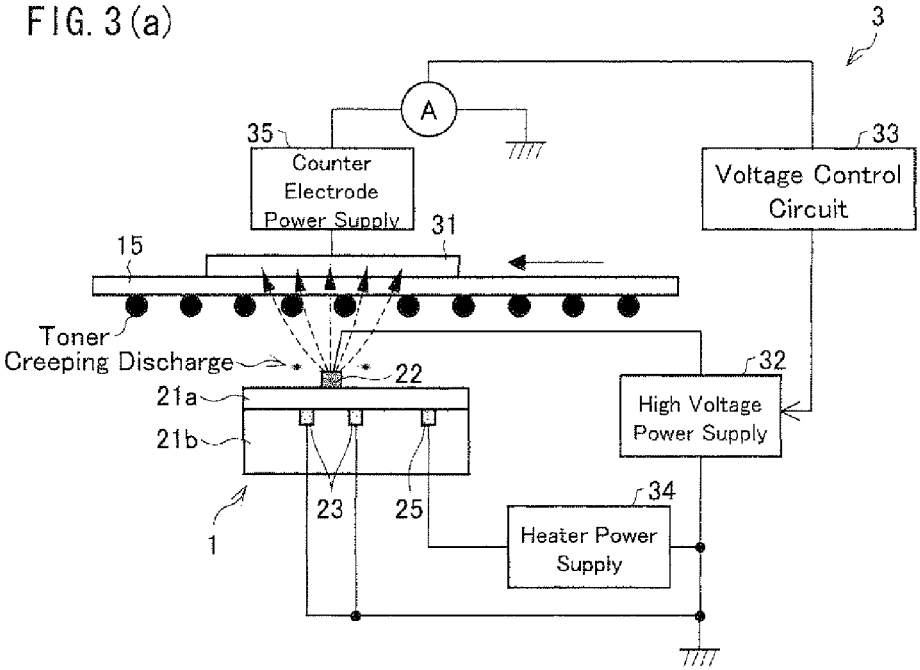
FIG. 3 (*a*) illustrates an arrangement of a charging device in accordance with the present invention.
Figure 3B:
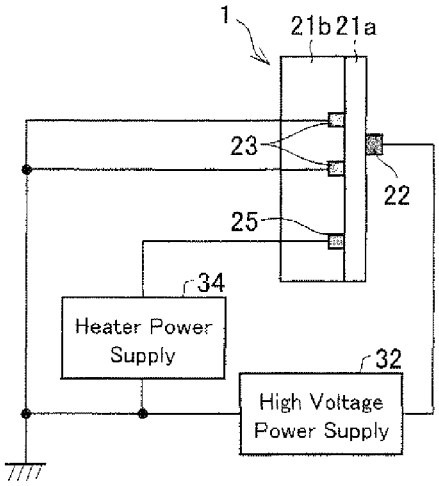
Figure 3C:
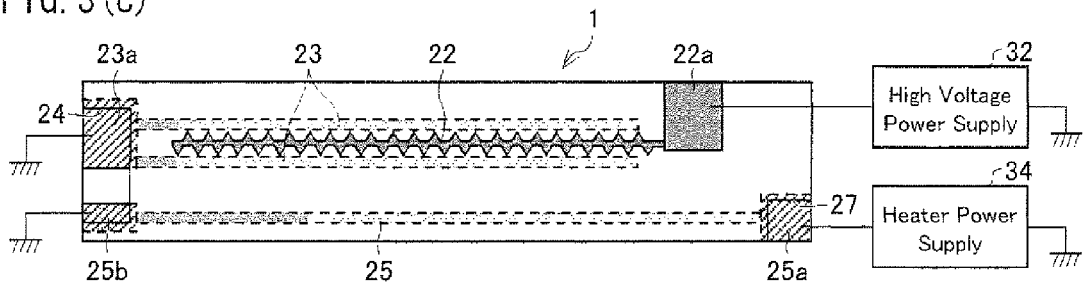

FIG. 3 (*a*) is an explanatory diagram illustrating an arrangement of the charging device 3 for charging before a second transfer including the ion generating device 1 which is provided in the vicinity of the intermediate transfer belt 15. FIGS. 3 (*b*) and 3 (*c*) are a side view and a plan view, respectively, of the ion generating device 1 which is connected to power supplies.

The charging device 3 for charging before a second transfer includes the ion generating device 1, a counter electrode 31, a high voltage power supply 32, and a voltage control circuit 33 (see FIG. 3 (*a*)).

The ion generating device 1 includes a dielectric layer 21*a*, a discharge electrode 22, the insulating base material 21*b*, induction electrodes 23, and a heater electrode 25 (see FIGS. 3 (*a*) and 3 (*b*)). The ion generating device 1 generates ions caused by discharge which occurs in accordance with an electric potential difference between the discharge electrode 22 and the respective induction electrodes 23 (corona discharge which occurs in the vicinity of the discharge electrode 22 in a creepage direction of the dielectric layer 21*a*).

The ion generating device 1 is arranged as a flat plate in which the dielectric layer 21*a* and the insulating base material 21*b* that are substantially rectangular are combined. In a case where an organic material is selected as a material of which each of the dielectric layer 21*a* and the insulating base material 21*b* is made, it is preferable that the material be a material which is highly resistant to oxidization. For example, it is possible to use resin such as polyimide or glass epoxy. On the other hand, when an inorganic material is selected as the material, it is possible to use ceramic such as a mica laminate material, alumina, crystallized glass, forsterite, or steatite. In view of corrosion resistance, it is more desirable that each of the dielectric layer 21*a* and the insulating base material 21*b* be made of the inorganic material. Furthermore, in view of formability, easiness in electrode formation (described later), low moisture resistance, or the like, it is preferable that each of the dielectric layer 21*a* and the insulating base material 21*b* be formed of ceramic. Moreover, it is desirable that an insulating resistance between the discharge electrode 22 and the respective induction electrodes 23 be uniform. Therefore, it is more preferable that each of the dielectric layer 21*a* and the insulating base material 21*b* be made of a material whose internal density is less fluctuating and have a more uniform insulating ratio. Further, it is preferable that the dielectric layer 21*a* have a thickness of 50 μm to 250 μm, but the thickness is not limited to this.

The dielectric layer 21*a* is long enough to cover the insulating base material 21*b*. The dielectric layer 21*a* includes (i) an opening section 24 in which a ground terminal section 23*a* of the induction electrodes 23 (described later) and a ground terminal section 25*b* of the heater electrode 25 are exposed and (ii) an opening section 27 in which a power supply connecting terminal section 25*a* of the heater electrode 25 is exposed (see FIG. 3 (*c*)). In the present embodiment, each of the ground terminal section 23*a* of the induction electrodes 23 and the ground terminal section 25*b* of the heater electrode 25 is exposed in the opening section 24. Alternatively, it is also possible to provide the ground terminal section 23*a* of the induction electrodes 23 and the ground terminal section 25*b* of the heater electrode 25 with their respective opening sections (see Example 2). The ground terminal section 23*a* of the induction electrodes 23 and the ground terminal section 25*b* of the heater electrode 25 are provided in one end part of and in a longitudinal direction of the insulating base material 21*b*, whereas the power supply connecting terminal section 25*a* of the heater electrode 25 is provided in the other end part of and in a longitudinal direction of the insulating base material 21*b*. The dielectric layer 21*a* extends long enough to cover the respective terminal sections in their extending direction. The dielectric layer 21*a* has, on the respective terminal sections, the opening section 24 and the opening section 27 in which the respective terminal sections are exposed.

The discharge electrode 22 is provided on a surface of the dielectric layer 21*a* so as to be integrated with the dielectric layer 21*a*. The discharge electrode 22 includes a high voltage power supply connecting terminal section 22*a*. The discharge electrode 22 can be made of a material such as tungsten, silver, gold, platinum, or stainless steel which is electrically conductive, provided that the material does not cause deformation such as meltdown or scattering due to discharge. The discharge electrode 22 can be coated with thin ceramic, glass, or the like so as to prevent a deterioration or a degradation in discharge electrode 22 due to use of the discharge electrode 22 over time. Note that in a case where the discharge electrode 22 is not uniformly coated, excessive discharge may occur in a thin coated part or an uncoated part of the discharge electrode 22. On the contrary, in a too thick coated part of the discharge electrode 22, a nonuniform image may be caused by a lack of discharge. Therefore, it is necessary to uniformly coat the discharge electrode 22. From such a viewpoint, it is the most preferable that the discharge electrode 22 be made of a material which is mainly composed of gold (Au) or platinum (Pt). The use of these materials is less likely to cause a deterioration in discharge electrode 22, for example due to oxidization of the discharge electrode 22 caused by discharge, and therefore allows the discharge electrode 22 to keep a stable performance for a long time without the need of separately providing a coating layer. Accordingly, it is possible to prevent nonuniform discharge due to a defective coating layer, to produce the discharge electrode 22 in a simple process, and to contribute to a reduction in cost and an improvement in quality.

It is desirable that the discharge electrode 22 have a uniform depth from the surface of dielectric layer 21*a* (in a case where the discharge electrode 22 is embedded in the dielectric layer 21*a* from the surface of the dielectric layer 21*a* toward the induction electrodes 23) or a uniform thickness (in a case where the discharge electrode 22 is provided so as to protrude from the surface of the dielectric layer 21*a*). The discharge electrode 22 can have any shape, provided that it evenly extends in a direction in which the discharge electrode 22 is at right angles to a direction in which the intermediate transfer belt 15 moves. Note that it is more desirable, if possible, to cause the discharge electrode 22 to have a shape which easily causes electric field concentration between the discharge electrode 22 and the respective induction electrodes 23. This is because such a shape allows discharge to be generated between the discharge electrode 22 and the respective induction electrodes 23 even if a low voltage is applied across the discharge electrode 22 and the respective induction electrodes 23. In the present embodiment, the discharge electrode 22 has a comb-tooth shape so that discharge is easily generated (see FIG. 3 (*c*)). Note here that, though the discharge electrode 22 has a comb-tooth shape, the discharge electrode 22 can also have a rectangular shape extending in a longitudinal direction of the dielectric layer 21*a*, as in arrangements illustrated in FIG. 1, FIGS. 4 (*a*) through 4 (*d*), FIG. 5 (*c*-1), FIG. 7 (*c*), and FIG. 8 (*c*-1).

The induction electrodes 23 are provided between the dielectric layer 21*a* and the insulating base material 21*b* so as to face the discharge electrode 22. This is because it is desirable that (i) the insulating resistance between the discharge electrode 22 and the respective induction electrodes 23 be uniform and (ii) the discharge electrode 22 and the induction electrodes 23 be juxtaposed to each other. Such an arrangement causes a distance between the discharge electrode 22 and the respective induction electrodes 23 (hereinafter referred to as a distance between electrodes) to be constant and stabilizes a discharge state between the discharge electrode 22 and the respective induction electrodes 23. It is therefore possible to suitably generate ions. In an arrangement illustrated in FIG. 3 (*c*), the induction electrodes 23 are two line-shaped electrodes which are provided so as to face each other and so that the discharge electrode 22 is located, in a longitudinal direction of the discharge electrode 22 and via the dielectric layer 21*a*, between the two line-shaped electrodes. Each of the induction electrodes 23 has one end to which the ground terminal section 23*a* is connected, and the ground terminal section 23*a* is grounded to have a a ground potential. The induction electrodes 23 are not limited to this in shape, and can be a solid electrode provided to face the discharge electrode 22 or can be a single induction electrode 23 which faces the discharge electrode 22.

In a case where a single dielectric layer 21*a* is provided, it is also possible to provide the induction electrodes 23 on a back surface of the dielectric layer 21*a*, instead of on the front surface of the dielectric layer 21*a*. However, in this case, it is necessary to secure a creeping distance sufficient for the applied voltage so that no electric leakage occurs between the discharge electrode 22 and the respective induction electrodes 23, via the surface of the dielectric layer 21*a*. Instead, it is necessary that the discharge electrode 22 and the induction electrodes 23 are coated with an insulating coating layer (protecting layer). However, note as is earlier described that the dielectric layer 21*a* should have a small thickness so that discharge is easy to occur. It follows that it is insufficient only to provide the dielectric layer 21*a* and the coating layer in terms of strength. In view of the circumstances, according to the present embodiment, a ceramic base material which has a thickness of several hundred μm to several mm is used as the insulating base material 21*b*. The induction electrodes 23 and the heater electrode 25 are patterned on the ceramic base material, are pressured against and stacked on the dielectric layer 21*a* on which the discharge electrode 22 is provided, and are then baked, thereby forming the ion generating device 1. This makes it possible to solve the problem in terms of strength. This also allows a prevention of a creeping leakage which will occur from the discharge electrode 22 provided on the surface of the ion generating device 1 to the induction electrodes 23 and to the heater electrode 25 which are provided inside the ion generating device 1. This is because the induction electrodes 23 and the heater electrode 25 are included in the insulating base material 21*b*. Furthermore, it is possible to simply produce the ion generating device 1 at a low cost because the ion generating device 1 is obtained by combining and baking two-layered ceramic base materials each having a electrode pattern.

The heater electrode 25 is provided, independently of the induction electrodes 23, between the dielectric layer 21*a* and the insulating base material 21*b* so as to have a line shape. Note here that the heater electrode 25 having the line shape is provided in the ion generating device 1 of the present embodiment so that a resistance per unit length is uniform, that is, a cross section of the heater electrode is uniform in areas where the respective terminal sections are provided and in a creeping discharge area. The heater electrode 25 is arranged so as to heat (i) the creeping discharge area, (ii) the area where the terminal section of the induction electrodes 23 is provided, (iii) the area where the terminal section of the discharge electrode 22 is provided and (iv) the areas where the terminal sections of the heater electrode 25 are provided. Namely, the ion generating device 1 of the present embodiment is arranged so that the vicinities of the respective terminal sections are also sufficiently heated by adjusting a thickness of a wire of the heater electrode 25. Therefore, according to such an arrangement, it is possible to cause a temperature decrease to be small in the areas where the terminal sections (contact point sections) of the electrodes are provided, i.e., in the area where the terminal section of the induction electrodes 23 is provided, in the area where the terminal section of the discharge electrode 22 is provided, and in the areas where the terminal sections of the heater electrode 25 are provided (see FIGS. 1 (*a*) and 1 (*b*)). This suppresses the dew condensation and the nitric acid generation which are described in the Technical Problem, and it is therefore possible to prevent damage to the terminal sections.

The heater electrode 25 can also be patterned so as to have a loop or wave line shape other than the shape as mentioned above. Moreover, the heater electrode 25 can be patterned under an optimum condition by appropriately adjusting a width or a thickness of the heater electrode 25 in accordance with electric resistivity of an electrode material to be used. In order to reduce a cost of the heater power supply 34, it is preferable to cause a heater power supply 34 to be driven by a common voltage (such as 5V, 12V, or 24V) used in a main body of the device. In that case, when it is necessary that the heater electrode 25 have a higher resistance so as to obtain a desired input power, a method can be appropriately employed, for example, a method for patterning the heater electrode 25 so that the heater electrode 25 has a loop shape, has a long line length, and has a broader line width. This is because there is a concern such as disconnection which may occur during production if the heater electrode 25 has an extremely narrow line width.

The heater electrode 25 has the ground terminal section 25*b* on one end thereof. The ground terminal section 25*b* is grounded to have a ground potential. The heater electrode 25 has the power supply connecting terminal section 25*a* on the other end thereof. The power supply connecting terminal section 25*a* is connected to the heater power supply 34. Note here that the ground terminal section 25*b* of the heater electrode 25 is provided in the vicinity of the induction electrode ground terminal section 23*a* (see in FIG. 3 (*c*)). However, the present embodiment is not limited to the arrangement. For example, the power supply connecting terminal section 25*a* of the heater electrode 25 can be provided in the vicinity of the induction electrode ground terminal section 23*a*.

The heater electrode 25 is arranged such that the heater electrode 25 generates Joule heat while a given voltage (12V in the present embodiment) is being applied to the heater electrode 25 by the heater power supply 34. The given voltage can be applied by continuously applying a direct-current voltage, by changing a common direct-current voltage in the device with the use of a regulator or the like, or by supplying a pulse-state voltage generated by a switching element such as a transistor. It is possible to appropriately control the heater electrode 25 in accordance with a start-up state, a steady state, a change over time, and/or a surrounding environment, by a combination of the foregoing resistance of the heater electrode 25 and the method for a voltage application. The ion generating device 1 thus increases in temperature (increases by approximately 20° C. relative to a surrounding temperature of the ion generating device 1 in the present embodiment) by causing the heater electrode 25 to be heated. This makes it possible to prevent the ion generating device 1 from absorbing humidity. This allows the ion generating device 1 to stably generate ions even under a high humidity environment.

Each of the heater electrode 25 and the induction electrodes 23 can be made of an electrically conductive material such as tungsten, silver, palladium, copper, nickel, gold, platinum, stainless steel, or an alloy thereof. A material which is mainly composed of silver, copper, or nickel is particularly suitable among these materials. Such a material has greater electric conductivity than a material such as stainless steel, and shows a preferable characteristic as an induction electrode material for smoothly supplying induced charge. In view of the fact that the electrodes are prepared by printing and baking a paste electrically conductive material, in a case where the dielectric layer 21*a* is made of ceramic or glass, an electrically conductive paste which is mainly composed of silver, copper, or nickel is comparatively inexpensive as compared with a paste of tungsten, gold, or platinum.

Gold or platinum is preferable as a material of which the discharge electrode 22 is made because of its large resistance characteristics. Gold or platinum is not necessarily used as a material of which each of the heater electrode 25 and the induction electrodes 23 is made, because discharge plasma does not directly act on those electrodes 23 and 25. Instead, it is preferable to use one of the materials (silver, copper, or nickel) in terms of reduction in cost. Further, it is possible to produce the terminal sections with no additional step and at a low cost by use of such an electrode material as it is. The terminal sections can be plated depending on the circumstances.

Figure 4:
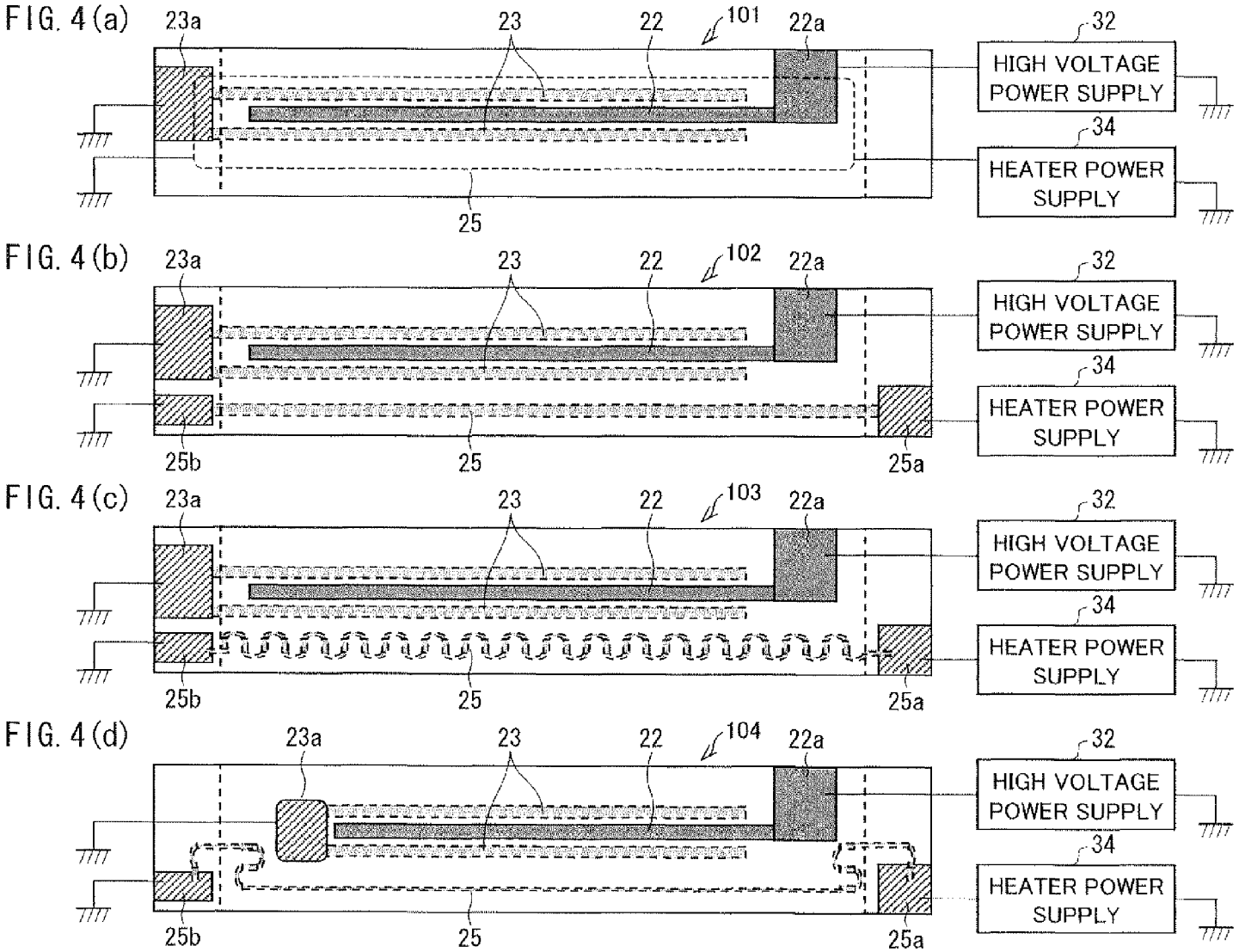
FIG. 4 (*a*) illustrates an example of the ion generating device of the embodiment of the present invention.
Figure 6:
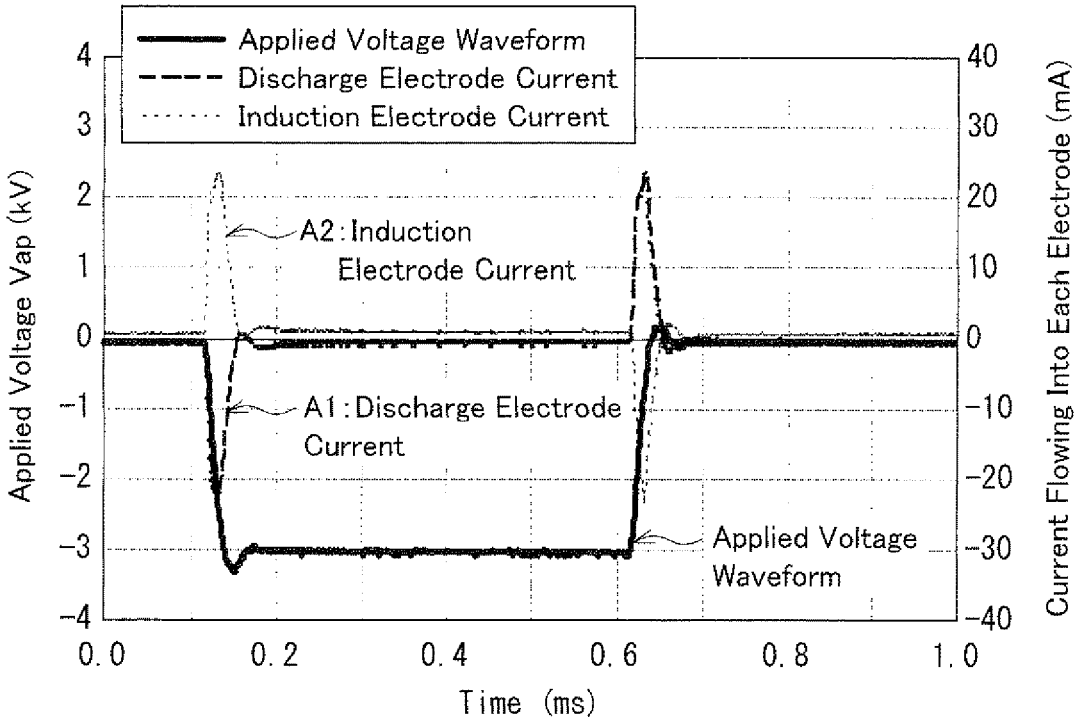
FIG. 6 (*a*) is a graph illustrating (i) an applied voltage waveform obtained while a pulse wave applied voltage is being applied to the ion generating device and (ii) waveforms of currents applied to a discharge electrode and an induction electrode, respectively.
Figure 6:
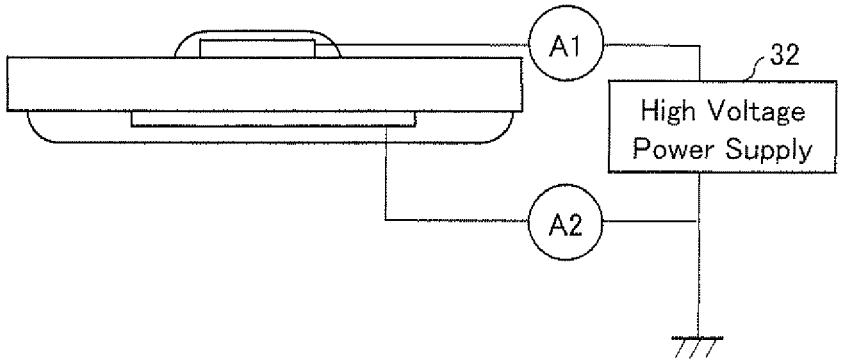

FIGS. 4 (*a*) through 4 (*d*) illustrate variations of the ion generating device of the present embodiment in each of which variations the heater electrode 25 is changed in shape. In an ion generating device 101 (see FIG. 4 (*a*)), the heater electrode 25 having a solid shape is provided so as to heat the high voltage power supply connecting terminal section 22*a* of the discharge electrode 22 and the ground terminal section 23*a* of the induction electrodes 23, in addition to the creeping discharge area.

In an ion generating device 102 (see FIG. 4 (*b*)), the heater electrode 25 having a line shape is provided so as to heat an area where the high voltage power supply connecting terminal section 22*a* of the discharge electrode 22 is provided, an area where the ground terminal section 23*a* of the induction electrodes 23 is provided, and areas where the respective terminal sections 25*a* and 25*b* which are located on both ends of the heater electrode 25 are provided, in addition to the creeping discharge area are heated and so as to cause a resistance per unit length to be constant in the areas where the respective terminal sections are provided and in the area where creeping discharge occurs, Namely, the heater electrode 25 is provided so that a cross section of the heater electrode 25 having the line shape is constant.

In an ion generating device 103 (see FIG. 4 (*c*)), the heater electrode 25 having a wavy line shape is provided so as to so as to heat an area where the high voltage power supply connecting terminal section 22*a* of the discharge electrode 22 is provided, an area where the ground terminal section 23*a* of the induction electrodes 23 is provided, and areas where the respective terminal sections 25*a* and 25*b* which are located on both ends of the heater electrode 25 are provided, in addition to the creeping discharge area are heated and so as to cause a resistance per unit length to be constant in the areas where the respective terminal sections 25*a* and 25*b* are provided and in the area where creeping discharge occurs. Namely, the heater electrode 25 is provided so that a cross section of the heater electrode 25 having the wavy line shape is constant.

An ion generating device 104 (see FIG. 4 (*d*)) illustrates a case where the ground terminal section 23*a* of the induction electrodes 23 is provided inside the device, instead of in an end part of the ion generating device 104. According to the ion generating device 104, the heater electrode 25 having a line shape is provided so as to heat an area where the high voltage power supply connecting terminal section 22*a* of the discharge electrode 22 is provided, an area where the ground terminal section 23*a* of the induction electrodes 23 provided inside the device is provided, and areas where the respective terminal sections 25*a* and 25*b* which are located on both ends of the heater electrode 25 are provided, in addition to the creeping discharge area. The heater electrode 25 does not necessarily have a resistance, around each of the terminal sections, which is identical with that in the discharge area. Namely, it is possible to appropriately select a resistance of each of the terminal sections. It is possible to appropriately adjust a wiring pattern of the heater electrode 25 in accordance with a resistance. The heater electrode 25 is provided so as to be drawn around and so as to be close to the high voltage power supply connecting terminal section 22*a* of the discharge electrode 22 and the ground terminal section 23*a* of the induction electrodes 23 provided inside the device.

In any of the ion generating devices illustrated in FIGS. 4 (*a*) through 4 (*d*), heated are the areas where the terminal sections are provided, i.e., the areas where the respective induction electrodes 23 are provided, the area where the discharge electrode 22 is provided, and the heater electrode 25, in addition to the creeping discharge.

The following describes a method for producing the ion generating device 1 of the present embodiment with reference to FIGS. 5 (*a*-1) through 5 (*c*-3). Note, however, that the method for producing the ion generating device 1 in accordance with the present invention should not be limited to the following method and values. FIGS. 5 (*a*-2), 5 (*b*-2), and 5 (*c*-2) are cross-sectional views taken from the lines a-a' of FIG. 5 (*a*-1), b-b' of FIG. 5 (*b*-1), and c-c' of FIG. 5 (*c*-1), respectively. FIG. 5 (*c*-3) is a side view of FIG. 5 (*c*-1).

First, a green sheet whose thickness is 0.2 mm and which is mainly composed of alumina and glass is used as the dielectric layer 21*a* (see FIGS. 5 (*a*-1) and 5 (*a*-2)). The discharge electrode 22 is formed on the dielectric layer 21*a* by screen printing so as to have a given pattern. It is possible to use one of the foregoing various materials as a material of which the discharge electrode 22 is made. Note here that the discharge electrode 22 is made of a material such as an electrically conductive paste which is mainly composed of gold (Au) and which contains ceramic and a glass component (1% to 2%) which serve as an adherer to ceramic.

Note that the ion generating device 1 is required to have a comparatively long length in the image forming apparatus 100 to which the ion generating device 1 of the present embodiment is applied. Therefore, it is preferable to use, as a ceramic material, a material of low temperature co-fired ceramic (LTCC) which substantially equally contains alumina and glass. This is because a calcination temperature is high in case of high temperature co-fired ceramic (HTCC) of pure alumina and an extremely-expensive and large-scale baking furnace is required to satisfy a baking condition for maintaining a uniform temperature distribution. This causes an increase in cost of the device. LTCC has an advantage of low calcination temperature, and is preferable because it allows an ion generating device having a comparatively long length (large size) to be stably produced at a low cost.

Next, a green sheet whose thickness is 0.8 mm and which is similar to the foregoing green sheet is used as the insulating base material 21*b* (see FIGS. 5 (*b*-1) and 5 (*b*-2)). Furthermore, the induction electrodes 23 and the heater electrode 25 are formed by a method similar to the foregoing method. It is possible to use one of the foregoing various materials as a material of which each of the heater electrode 25 and the induction electrodes 23 is made. Note here that each of the heater electrode 25 and the induction electrodes 23 is made of an electrically conductive paste which is mainly composed of silver (Ag) with which approximately 5% palladium is mixed, and which and contains ceramic and a glass component (1% to 2%) which serves as an adherer to ceramic.

The opening section 24 and the opening section 27 are provided in advance in the dielectric layer 21*a* above the insulating base material 21*b* so that the opening section 24 corresponds to the ground terminal section 23*a* of the induction electrodes 23 and the ground terminal section 25*b* of the heater electrode 25, and so that the opening section 27 corresponds to the power supply connecting terminal section 25*a* of the heater electrode 25 (see FIG. 5 (*a*-1)). In the present embodiment, the opening section 24 is provided so as to be shared by the ground terminal section 23*a* of the induction electrodes 23 and the ground terminal section 25*b* of the heater electrode 25. Instead, it is also possible to provide opening sections for the respective terminal sections 23*a* and 25*b* (see Example 2 described with reference to FIG. 4 (*d*) and FIGS. 8 (*a*-1) through 8 (*c*-3)).

Subsequently, the dielectric layer 21*a* is pressured against and stacked on the insulating base material 21*b* (see FIGS. 5 (*c*-1), 5 (*c*-2), and 5 (*c*-3)). In this case, it is necessary to be careful (i) of positioning of the dielectric layer 21*a* and the insulating base material 21*b* and (ii) to prevent an entry of a bubble or a foreign matter into between the dielectric layer 21*a* and the insulating base material 21*b*. Then, the dielectric layer 21*a* and the insulating base material 21*b* which are in a stacked state are cut into a given size (for example, 6 mm in width×320 mm in length) and baked in an electronic furnace at a temperature of 900° C. to 1000° C. This allows the ion generating device 1 composed of a ceramic material to be prepared.

The counter electrode 31 of the present embodiment, having a shaft shape, which is made of stainless steel (refer to FIG. 3 (*a*) again). The counter electrode 31 is provided so as to face the ion generating device 1 via the intermediate transfer belt 15, and so as to be in close contact with a back surface (a surface on which no toner image is formed) of the intermediate transfer belt 15. The counter electrode 31 is connected to a counter electrode power supply 35 which is grounded. The counter electrode power supply 35 is arranged to apply a given voltage to the counter electrode 31. This kind of counter electrode power supply 35 is provided so that the discharge electrode 22 easily discharges. As such, the counter electrode power supply 35 is not necessarily required, but is dispensable.

The high voltage power supply (a voltage application circuit) 32 is controlled by the voltage control circuit 33 so as to apply a voltage across the discharge electrode 22 and the induction electrodes 23 of the ion generating device 1. Such a voltage has a pulse wave (see FIG. 6 (*a*)) whose voltage Vpp falls within a range of 2 kV to 4 kV, whose offset bias falls within a range of −1 kV to −2 kV, and whose frequency falls within a range of 500 Hz to 2 kHz. A high-voltage-side-time duty of the pulse wave is arranged to be 10% to 50%. Note that the waveform can be a sine wave. However, the pulse wave is more preferable in view of discharge efficiency, particularly in view of discharge performance under a high humidity condition. It is unnecessary to pretend to suppress each overshoot which occurs in the pulse wave in response to a rising edge or a falling edge (see the waveform in FIG. 6 (*a*)). Rather, there are some cases where it can be possible to reduce a cost of the power supply by actively employing the overshoot.

When an alternating high voltage is applied across the discharge electrode 22 and the respective induction electrodes 23 by causing the high voltage power supply 32 as arranged above to operate, creeping discharge (corona discharge) occurs in the vicinity of the discharge electrode 22 due to an electric potential difference between the discharge electrode 22 and the respective induction electrodes 23. This ionizes an atmosphere surrounding the discharge electrode 22, and generates negative ions, so that a toner image on the intermediate transfer belt 15 is charged to a given amount (approximately −30 μC/g here).

Further, the high voltage power supply 32 is connected to the voltage control circuit 33. The voltage control circuit 33 controls a voltage outputted by the high voltage power supply 32. Specifically, the voltage control circuit 33 measures a current flowing through the counter electrode power supply 35, and carries out feedback control of a voltage outputted by the high voltage power supply 32 so that the measured current is coincident with a target value. A current flowing through the counter electrode 31 correlates with a charge amount of the toner image. Therefore, while the current flowing through the counter electrode 31 is being kept to be a constant target one, a corresponding constant charge amount of the toner image is obtained. By thus carrying out feedback control, in accordance with a current flowing through the counter electrode 31, with respect to a voltage to be applied to the high voltage power supply 32, it is possible to constantly supply an appropriate amount of ions to the toner image, even if an amount of ions generated or a ratio of the generated ions reaching the toner image fluctuates due to (i) an adherence of a foreign matter to a tip of the discharge electrode 22, (ii) a change in environmental condition, (iii) a change in wind current in the image forming apparatus 100, and/or the like. Note, however, it is not necessarily required to carry out the control in accordance with the current flowing through the counter electrode. Instead, the control can be carried out in accordance with information on a surrounding environment, a degree of a use over time, and/or a printing mode by use of a control table or the like prepared based on prior consideration.

As described earlier, the ion generating device 1 of the present embodiment is arranged such that the induction electrodes 23 and the heater electrode 25 are surrounded by the dielectric layer 21*a* and the insulating base material 21*b*. Accordingly, a creeping leakage from the discharge electrode 22 to the respective induction electrodes 23 or to the heater electrode 25 is difficult to occur, and Joule heat generated by supplying electric power to the heater electrode 25 removes absorption moisture in the vicinity of the discharge electrode 22. This causes discharge performance to be stabilized. Further, the arrangement is so simple as to provide a device at a low cost.

The ion generating device 1 is arranged such that (i) the induction electrodes 23 and (ii) the heater electrode 25 are spaced so as to be electrically insulated from each other. Advantages of the arrangement are described below with reference to FIGS. 7 (*a*) through (*c*). FIG. 7 (*a*) illustrates an ion generating device in which one end of the heater electrode 25 is connected to the heater power supply 34 and the other end of the heater electrode 25 and the induction electrodes 23 are connected to a common ground terminal section 26 which is grounded (has a ground electric potential). FIG. 7 (*b*) illustrates an ion generating device in which a common ground terminal section 26 is floating (is not grounded). FIG. 7 (*c*) illustrates an ion generating device in which (i) the induction electrodes 23 and (ii) the heater electrode 25 are electrically insulated from each other.

In a case where (i) the induction electrodes 23 and (ii) the heater electrode 25 are electrically connected via the common ground terminal section 26 (see FIG. 7 (*a*)), no serious problem occurs in a normal use. However, in a case where the common ground terminal section 26 is floating (is not grounded) (see FIG. 7 (*b*)), there occurs an unstable state because an electric potential of the induction electrodes 23 is affected by an electric potential of the discharge electrode 22 in response to a high voltage which is applied to the discharge electrode 22. Further, an induced current flows into the heater power supply 34 via, the heater electrode 25. In such a case, an unstable voltage affects the heater power supply 34. This causes noise to be induced, the heater power supply 34 to be damaged, and consequently a main body to break or an accident such as ignition to occur.

On the other hand, in a case where (i) the induction electrodes 23 and (ii) the heater electrode 25 are electrically insulated from each other (see FIG. 7 (*c*)), it is possible to avoid damage to a main body of the device via the heater electrode 25 even if the induction electrodes 23 is floating. An electric leakage to the heater electrode 25 can thus be prevented in the present embodiment. This also allows prevention of a breakage in the main body of the device including the ion generating device 1 and a fire accident, without causing the heater power supply 34 to break. Accordingly, it is possible to provide an ion generating device with due considerations to safety. In such a case, it is preferable to secure a great distance between a contact point of the induction electrodes 23 and a contact point of the heater electrode 25 (see FIG. 8 (*c*-1)) so as to further ensure safety. This is because of the following reason. In a case where the contact point of the induction electrodes 23 is floating, an electric potential of a terminal section of the induction electrodes 23 is affected by an electric potential of a high voltage applied to the discharge electrode 22, and then becomes high. As such, a creeping leakage may occur in a case where the contact point of the induction electrodes 23 is close to the contact point of the heater electrode 25. In contrast, it is possible to prevent such a phenomenon in the case of securing a great distance between the contact point of the induction electrodes 23 and the contact point of the heater electrode 25.

Furthermore, in the arrangement of FIG. 8 (*c*-1), the dielectric layer has a notch whose shape is elliptical or circular. Such a shape is preferable because it is possible to prevent the dielectric layer from being cracked and/or damaged due to stress concentration. Note that FIG. 8 (*c*-1) is a modification of the ion generating device illustrated in FIG. 4 (*d*). An ion generating device of FIG. 8 (*c*-1) exemplifies a case where it is necessary to narrow a width of the device, and relates to a case where two terminal sections are shifted in a longitudinal direction of the device because it is impossible to provide the two terminal sections in a width (transverse) direction of the device. Moreover, the ion generating device illustrated in FIG. 8 (*c*-1) is arranged such that an opening section 24*a* and an opening section which face the ground terminal section 23*a* of the induction electrodes 23 inside the device and the ground terminal section 25*b* of the heater electrode 25, respectively, are elliptically provided. Note here that FIGS. 8 (*a*-1) and 8 (*a*-2) are an elevational view and a side view, respectively, of the dielectric layer 21*a* in which the respective opening sections 24*a* and 24*b* are elliptically provided and the discharge electrode 22 is further provided. FIGS. 8 (*b*-1) and 8 (*b*-2) are an elevational view and a side view, respectively, of the insulating base material 21*b* in which the induction electrodes 23 and the heater electrode 25 are provided. FIGS. 8 (*c*-1), 8 (*c*-2), and 8 (*c*-3) are an elevational view, a transverse side view, and a longitudinal side view, respectively, of the modification of the ion generating device of the present embodiment in which the dielectric layer 21*a* (see FIGS. 8 (*a*-1) and 8 (*a*-2)) and the insulating base material 21*b* (see FIGS. 8 (*b*-1) and 8 (*b*-2)) are stacked.

Example 1

The following describes examples in each of which an ion generating device of the present invention is employed. Note here that the following describes the ion generating devices of the respective examples in accordance with the present invention and ion generating devices of respective comparative examples with reference to FIG. 1, FIG. 4 (*a*) through (c), and FIG. 10 (*a*-1) through 10 (*c*-1).

An ion generating device of an example illustrated in FIG. 4 (*a*) has an arrangement similar to an ion generating device of a comparative example illustrated in FIG. 10 (*a*-1). The ion generating device of the example illustrated in FIG. 4 (*a*) is arranged to include a solid heater electrode provided on a back surface of an insulating base material. Note, however, that the ion generating device of the example illustrated in FIG. 4 (*a*) is arranged so that the vicinities of a contact point of an induction electrode and a contact point of a discharge electrode is also highly efficiently heated.

An ion generating device of an example illustrated in FIG. 4 (*b*) has an arrangement similar to an ion generating device of a comparative example illustrated in FIG. 10 (*b*-1). Note, however, that the ion generating device of the example illustrated in FIG. 4 (*b*) is arranged so that the vicinities of respective contact points are also sufficiently heated by adjusting a thickness of a line-shaped heater electrode.

An ion generating device of an example illustrated in FIG. 4 (*c*) has an arrangement similar to an ion generating device of a comparative example illustrated in FIG. 10 (*c*-1). Note, however, that the ion generating device of the example illustrated in FIG. 4 (*c*) is arranged so that the vicinities of respective terminal sections are also sufficiently heated by extending a pattern of a wavy line-shaped heater electrode.

Figure 1:
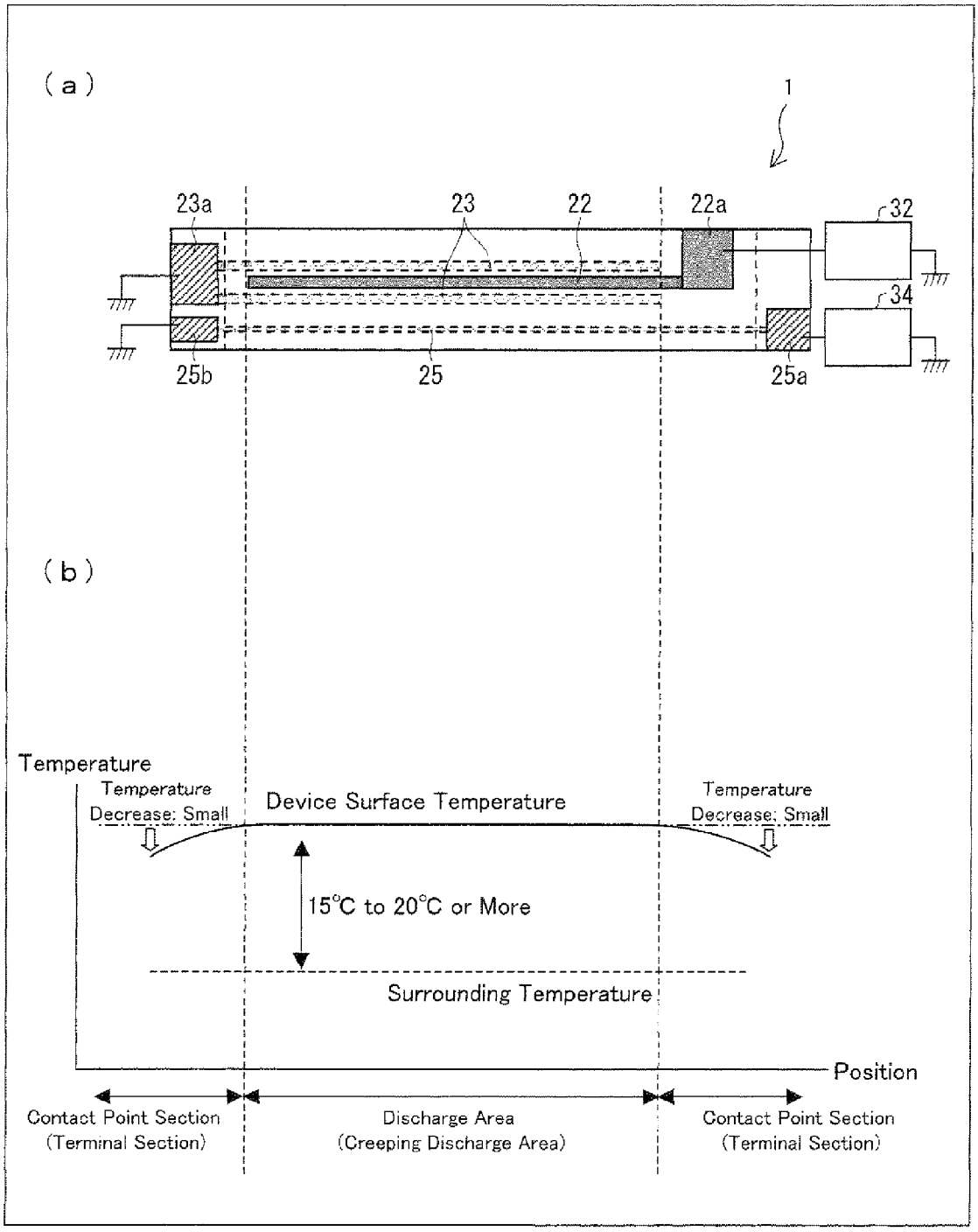

Accordingly, it is possible to cause a temperature decrease to be small in the areas of the respective terminal sections (see (a) and (b) of FIG. 1), by applying, to an ion generating device, the arrangements illustrated in FIGS. 4 (*a*) through 4 (*c*) which are the present examples. This suppresses dew condensation and nitric acid generation, and it is therefore possible to prevent damage to the respective terminal sections.

FIG. 9 (*a*) shows (i) a temperature measurement result of each of ion generating devices of respective two Comparative Examples 1 and 2 and (ii) a temperature measurement result of the ion generating device of the present example. FIG. 9 (*b*) illustrates an arrangement of the ion generating device of Comparative Example 1 or 2 which was subjected to the temperature measurement. FIG. 9 (*c*) illustrates an arrangement of the ion generating device of the present example which was subjected to the temperature measurement.

According to the ion generating device of Comparative Example 1 or 2, a heater electrode 26*b* has a broader width in areas (1) and (6) where respective terminal sections are provided than in areas (2) through (5) where creeping discharge occurs (see FIG. 9 (*b*)). On the other hand, according to the ion generating device of the present example, the heater electrode 25 has an identical width irrespective of areas (areas (1) through (6)), that is, irrespective of areas where respective terminal sections are provided or areas where creeping discharge occurs (see FIG. 9 (*c*)). The following is a comparison relation of the width of the heater electrode in the areas (1) and (6), the widths of Comparative Examples 1 and 2, and the present example.

Comparative Example 2>Comparative Example 1>Present Example=the width of the heater electrode in the areas (areas (2) through (5)) where creeping discharge occurs.

Specific widths of the heater electrodes were set as follows. A width of the heater electrode was set to 0.15 mm in the areas (2) through (5) of the present example. A width of the heater electrode where creeping discharge occurs was set to 0.15 mm in the areas (2) through (5) of Comparative Examples 1 and 2 where creeping discharge occurs was set to 0.15 mm. A width of the heater electrode was set to 0.15 mm in the areas (1) and (6) of the present example where the respective terminal sections are provided. A width of the heater electrode was set to 0.5 mm in the areas (1) and (6) of Comparative Example 1 where the respective terminal sections are provided. A width of the heater electrode was set to 1.0 mm in the areas (1) and (6) of the Comparative Example 2 where the respective terminal sections are provided.

The line widths of the heater electrode are employed as mere examples in the present example and Comparative Examples 1 and 2, and are therefore not limited. For example, in a case where the heater electrode is formed so as to have a line shape, it is preferable that the heater electrode have a line width of 0.1 mm to 0.2 mm in the creeping discharge area, though the line width varies depending on an electrode material or use conditions.

In the present example and in each of Comparative Examples 1 and 2, the temperature measurement was carried out in each of the areas (1) through (6) of the ion generating device under the conditions that an input power was approximately 3 W and a room temperature was approximately 25° C. The temperature measurements were carried out by a radiation thermometer (i) in two areas (in the areas (1) and (6)) located at both ends of the heater electrode (in the vicinity of contact point terminals) where the respective terminal sections are provided and (ii) in four areas (in the areas (2) through (5)) where creeping discharge (discharge) occurs (see FIGS. 9 (*b*) and 9 (*c*)). Note that scale markings 1 through 6 in a transverse axis in FIG. 9 (*a*) correspond to the areas (1) through (6), respectively, in FIG. 9 (*b*) or 9 (*c*).

FIG. 9 (*a*) shows that the heater electrode has a large width in the areas (1) and (6), namely, the ion generating device of Comparative Example 2 which is small in heating amount has a larger temperature decrease than the ion generating device of Comparative Example 1. FIG. 9 (*a*) also shows that the ion generating device of Comparative Example 1 has a larger temperature decrease than the ion generating device of the present example.

In the present example and Comparative Examples 1 and 2, each of the heater electrode, the induction electrode, and their terminal sections was made of a baked powdery paste in which silver and palladium (5%) were mixed.

As shown in FIG. 9 (*a*), there is a temperature difference of approximately 15° C. between Comparative Examples 1 and 2. The ion generating devices of respective Comparative. Examples 1 and 2 were subjected to a discharge aging test under a high humidity environment. The test demonstrated, in several dozen hours, that a droplet of nitric acid was adhered to a surface of the device and an electrode contact point tarnished and stained. On the other hand, a temperature difference is in the range of 5° C. to 10° C. in the present example. The ion generating device of the present example was subjected to the discharge aging test under the high humidity environment similarly to the ion generating devices of respective Comparative Examples 1 and 2. The test demonstrated that an adherence of nitric acid and a deterioration in electrode were suppressed.

In Comparative Example 1, a temperature difference between the area (1) where the terminal section is provided and the areas where creeping discharge occurs (the areas (2) through (5) on average) was beyond 10° C. Further, in Comparative Example 1, there occurred a malfunction due to dew condensation in the vicinity of the terminal provided in the area (1). On the other hand, there occurred no malfunction in the area (6) where the terminal section is provided. This is because a temperature decrease was slightly less than 10° C. in the area (6).

This demonstrates that it is possible to use silver, copper, nickel, or the like as an electrode material in a case where a malfunction due to dew condensation is difficult to occur. These materials are not so resistant to nitric acid, but inexpensive. Accordingly, even if these electrode materials are used, the arrangement of the present invention makes it possible to provide a safe ion generating device which is low in cost and which keeps a stable performance.

Example 2

The following describes another example of the ion generating device in accordance with the present invention with reference to FIG. 4 (*d*) and FIGS. 8 (*a*-1) through 8 (*c*-3). In the present example, a heater arranged as illustrated in FIG. 4 (*d*) is employed as a pattern of the heater electrode for heating the vicinity of respective terminal sections. As described earlier, in a case where the heater electrode and the induction electrode are spaced, it is desirable to secure a great distance between their respective contact points. In this case, the arrangement of the present example is more suitable.

An ion generating device of the present example is arranged such that the ground terminal section 23*a* of the induction electrodes 23 and the ground terminal section 25*b* of the heater electrode 25 have their respective opening sections in the dielectric layer 21*a*, in addition to the arrangement of the ion generating device 1 described in the embodiment (see FIG. 4 (*d*)). Namely, opening sections (24*a* and 24*b* are provided on the ground terminal section 23*a* of the induction electrodes 23 and the ground terminal section 25*b* of the heater electrode 25, respectively. Note here that FIGS. 8 (*a*-1) and 8 (*a*-2) are an elevational view and a side view, respectively, of the dielectric layer 21*a* in which the respective opening sections are provided and the discharge electrode 22 is further provided. FIGS. 8 (*b*-1) and 8 (*b*-2) are an elevational view and a side view, respectively, of the insulating base material 21*b* in which the induction electrodes 23 and the heater electrode 25 are provided. FIGS. 8 (*c*-1), 8 (*c*-2), and 8 (*c*-3) are an elevational view, a transverse side view, and a longitudinal side view, respectively, of the ion generating device of the present example in which the dielectric layer 21*a* (see FIGS. 8 (*a*-1) and 8 (*a*-2)) and the insulating base material 21*b* (see FIGS. 8 (*b*-1) and 8 (*b*-2)) are stacked.

Example 3

The following describes a further example of the ion generating device in accordance with the present invention. In the present example, gold or platinum is used as a material of the discharge electrode 22. Except for this, the ion generating device has an arrangement similar to the above arrangement. The following describes why it is desirable to use gold or platinum as the material of the discharge electrode 22.

In terms of prevention of dew condensation and nitric acid generation, it is desirable that the vicinity of a discharge electrode terminal section (contact point section (high-voltage contact point)) to which a high voltage is applied be also heated. However, in a case where the heater electrode 25 is extended to the vicinity of such a high-voltage terminal section (the discharge electrode terminal section), noise due to a high voltage may be given to the heater electrode 25 and/or an electric leakage to the heater electrode 25 will occur if a dielectric layer should break. In this case, it is sometimes difficult to heat the vicinity of a high-voltage contact point.

However, in a case where the discharge electrode 22 is made of a material such as gold or platinum as in the present example, it is possible to cause the vicinity of the high-voltage terminal section to be less heated by the heater electrode 25 which prevents dew condensation. This is because the material, such as gold or platinum is highly resistant to damage from nitric acid. Accordingly, it is possible to solve the problems as described above without the need of causing the heater electrode 25 to extend to the vicinity of the high-voltage terminal section.

Furthermore, as described earlier, the material such as gold or platinum is also highly resistant to oxidization by ozone generated by discharge, and therefore show a long-term stable discharge characteristic. Note that it is possible to cause even a material which is less resistant to oxidization to have greater durability in a case where the discharge electrode 22 is coated with thin ceramic or glass. But then, this causes (i) non-uniform discharge to occur due to an uneven coating layer or damage to the coating layer which occurs during use and (ii) an increase in cost because of the necessity of adding a separate step of forming the coating layer during production. In view of the circumstances, it is preferable to use the material such as gold or platinum.

As described earlier, an ion generating device in accordance with the present invention, includes a discharge electrode and an induction electrode provided to face each other via a dielectric layer, the ion generating device generating ions in response to creeping discharge caused by applying an alternating voltage across the discharge electrode and the induction electrode, the induction electrode being provided in an insulating base material, a heater electrode, provided on the insulating base material, which generates, in response to electric power being supplied, Joule heat for causing the ion generating device to be heated, the heater electrode being wired so as to heat (i) a creeping discharge area where the creeping discharge occurs and (ii) areas where respective terminal sections of the induction electrode, the discharge electrode, and the heater electrode are provided.

According to the arrangement, an ion generating device which is low in cost, which keeps stably operating even if there is a change in environment where the ion generating device is used, and which cares for safety.

It is more suitable to arrange the ion generating device in accordance with the present invention such that the heater electrode is arranged so that a temperature difference between the creeping discharge area and the respective areas where the respective terminal sections are provided falls within 10° C.

In order to cause the temperature difference to fall within 10° C., it is possible to cause the heater electrode to further heat the areas where the respective terminal sections are provided or to secure a large surrounding area for arranging the heater electrode. Note that specific conditions for the arrangement vary depending on (i) respective thicknesses, (ii) thermal conductivity, and (iii) a surrounding state of heat radiation of the dielectric layer and the insulating base material which are provided in the areas where the respective terminal sections are provided. However, it is possible to cause the temperature difference to fall within 10° C. by appropriately setting a resistance or a wiring pattern of the heater electrode.

According to the arrangement, it is possible to suppress dew condensation in the vicinities of the respective terminal sections when the temperature difference between the creeping discharge area and the areas where the respective terminal sections are provided falls within 10° C. Ideally speaking, it is the most preferable that the temperature difference be 0 (zero). However, various detection means and control means are required to realize this. Further, requirements for the arrangement of the heater electrode become complicated and a design likelihood also becomes low. This causes an increase in cost. In view of the circumstances, in order to address the problems, it is preferable to arrange the ion generating device such that the temperature difference falls within 10° C. This is because it is possible to simply prevent dew condensation at a low cost by causing the temperature to fall within 10° C.

The ion generating device in accordance with the present invention can be arranged such that the heater electrode is provided, so as to have a line-shaped pattern, on a surface of the insulating base material on which surface the induction electrode is provided.

According to the arrangement, it is possible to concurrently form the heater electrode and the induction electrode. This makes it possible to provide, at a low cost, an ion generating device whose layer is simply arranged.

The ion generating device in accordance with the present invention can be arranged such that the heater electrode is provided, so as to have a solid shape, on a surface of the insulating base material which surface is opposite to a surface where the induction electrode is provided.

It is preferable to arrange the ion generating device in accordance with the present invention such that the induction electrode and the heater electrode are electrically insulated from each other.

In a case where the induction electrode and the heater electrode are not insulated from each other, for example, in a case where the induction electrode and the heater electrode are connected to any electric potential (e.g. a ground potential) via a common terminal section, the following may occur. In a case where the induction electrode and the heater electrode are floating due to an accident such as loose connection which occurs in the common terminal section, a high voltage applied to the discharge electrode causes an unstable state in which an electric potential of the induction electrode is affected by an electric potential of the discharge electrode. Further, an induced current generated while a high voltage is being applied to the discharge electrode flows into a heater power supply via the heater electrode. In such a case, an unstable voltage affects the heater power supply. This causes noise to be induced, the heater power supply to be damaged, and ultimately an accident such as ignition to occur.

In order to address the problems, the induction electrode and the heater electrode may be insulated from each other. According to such an arrangement, it is possible to prevent damage, via the heater electrode, to the heater power supply and a main body including the ion generating device even if the induction electrode is floating due to loose connection caused by some accident. This allows prevention of an accident such as ignition. However, in such an arrangement, the vicinity of a contact point of the induction electrode, for example, is less heated by the heater. This may cause the foregoing various problems related to dew condensation.

In view of the circumstances, according to the present invention, it is possible to arrange the heater electrode so that the terminal section of the induction electrode is also heated, to avoid various problems related to dew condensation, and to prevent the foregoing risk such as loose connection.

It is preferable to arrange the ion generating device in accordance with the present invention such that the terminal section of the discharge electrode is made of an electrically conductive material which is mainly composed of gold or platinum.

A high voltage is applied to the terminal section of the discharge electrode out of the electrode terminal sections (contact point sections for supplying power) of the ion generating device in accordance with the present invention.

Therefore, an induced current may be induced also to the heater electrode in a case where the heater electrode is provided in the vicinity of the terminal section of discharge electrode so as to prevent dew condensation around its contact point section. Alternatively, a high voltage may leak to the heater line when a breakage in the dielectric layer or a pinhole occurs. However, when the discharge electrode is made of gold or platinum as in the arrangement of the present invention, it is possible to reduce limitations under which the heater electrode is arranged so as to prevent dew condensation. Namely, it is possible to reduce the foregoing risk such as an electric leakage without the need of causing the heater electrode to be so close to the terminal section of the discharge electrode.

Furthermore, it is possible to obtain a long-term stable discharge performance by employing the arrangement. This is because the discharge electrode is highly resistant to oxidization caused by ozone generation in response to discharge and its electric characteristic as a discharge electrode is therefore difficult to change. Namely, the discharge electrode itself is highly durable, and it is therefore possible to simply produce a discharge electrode without the need of separately providing a coating layer for protecting the discharge electrode. Further, the arrangement is more preferable because it is possible to prevent a risk such as an uneven coating layer or non-uniform discharge caused by a deterioration in coating layer due to long-term use.

It is preferable to arrange the ion generating device in accordance with the present invention such that each of the induction electrode and the heater electrode is made of an electrically conductive material which is mainly composed of silver, copper, or nickel.

The induction electrode or the heater electrode may be made of an electrically conductive material which is mainly composed of a material other than gold. It is preferable to arrange the induction electrode or the heater electrode by use of an inexpensive material other than gold in terms of reduction in cost. In terms of reduction in cost of the heater power supply, it is preferable to cause the heater electrode to be driven by a common voltage (such as 5V, 12V, or 24V) used in the device, as the heater power supply. However, in such a case, in order to obtain a desired input power, it is necessary to control the heater electrode so that the heater electrode has a resistance in a given range. Note here that in a case where the heater electrode is made of a material which is mainly composed of gold, it is necessary to cause the heater electrode to have a large wiring length and a small line width in a case where the heater electrode has an extremely low resistance but a desired resistance is high. However, such a wiring pattern causes a yield to deteriorate by a disconnection which occurs during production. In addition, a gold material is expensive, which may cause an increase in cost.

In order to address these problems, it is preferable to use silver, copper, or nickel as an electrically conductive material of which each of the induction electrode and the heater electrode is made. The use of these materials is easier to increase a resistance than the use of a gold material, and it is possible to reduce the risk of disconnection due to an excessive reduction in line width of the wiring pattern. Further, in a case where ceramic, glass, and the like are used as materials of which the insulating base material or the dielectric layer is made, it is preferable to combine these materials, which need to be baked at a high temperature, with a material such as silver, copper, or nickel which is highly resistant to heat.

A material such as silver, copper, or nickel is easy to deteriorate by nitric acid. However, nitric acid is difficult to be generated by use of the arrangement of the heater of the present invention in combination with the material. Therefore, it is possible to provide a highly-reliable and low-cost ion generating device.

In order to solve the problems, a charging device in accordance with the present invention includes: an ion generating device as mentioned above; a power supply section for applying the alternating current across the discharge electrode and the induction electrode; and a heater power supply section for supplying the electric power to the heater electrode.

According to the arrangement, the charging device in accordance with the present invention includes the ion generating device in accordance with the present invention. Therefore, it is possible to provide a charging device which is low in cost, which stably operates by preventing a malfunction in the terminal section due to dew condensation, and which cares for safety.

In order to solve the problems, an image forming apparatus in accordance with the present invention includes: a transfer receiving body; a bearing member for bearing a toner image transferred to the transfer receiving body; and a charging device for charging before a transfer, the charging device for charging before a transfer being a charging device as mentioned above.

When the charging device of the present invention is used as the charging device for charging before a transfer, it is possible to avoid damage to a main body of the image forming apparatus by the charging device which is so safe as to stably operate by preventing a malfunction in the electrode terminal section due to dew condensation. Accordingly, it is possible to provide a safe image forming apparatus. Furthermore, the charging device of the present invention is compact as described earlier, and it is therefore possible to charge toner before a transfer in a limited space. This allows miniaturization of an image forming apparatus.

An image forming apparatus in accordance with the present invention includes: an electrostatic latent image bearing member; and a charging device for charging the electrostatic latent image bearing member, the charging device being a charging device as mentioned above.

When the charging device in accordance with the present invention is used as the charging device for charging the electrostatic latent image bearing member, it is possible to avoid damage to a main body of the image forming apparatus by the charging device which is so safe as to stably operate by preventing a malfunction in the electrode terminal section due to dew condensation. Accordingly, it is possible to provide a safe image forming apparatus. Furthermore, the charging device of the present invention is compact, and it is therefore possible to provide a compact image forming apparatus.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The present invention can be used as a charging device of an image forming apparatus employing an electrophotographic method, the charging device for carrying out: (i) charging of a toner image which is formed on an image bearing member such as a photoreceptor and an intermediate transfer member and has not been transferred yet; (ii) latent-image charging for charging the photoreceptor; and (iii) auxiliary charging for helping charging of toner in a developing device.

REFERENCE SIGNS LIST

1 Ion generating device
2 Charging device for charging before a first transfer (Charging device)
4 Latent image charging device (Charging device)
3 Charging device for charging before a second transfer (Charging device)
7 Photoreceptor
15 Intermediate belt
21*a* Dielectric layer
21*b* Insulating base material
22 Discharge electrode
22*a* High voltage power supply connecting terminal section of discharge electrode (Terminal section)
23 Induction electrode
23*a* Ground terminal section of induction electrodes (Terminal section)
24, 24*a*, 24*b* Opening section
25 Heater electrode
25*a* Power supply connecting terminal section of the heater electrode (Terminal section)
25*b* Ground terminal section of the heater electrode (Terminal section)
27 Opening section
31 Counter electrode
32 High voltage power supply (Power supply section)
33 Voltage control circuit
34 Heater power supply
35 Counter electrode power supply
100 Image forming apparatus

The invention claimed is:

1. An ion generating device, comprising a discharge electrode and an induction electrode provided to face each other via a dielectric layer, which generates ions in response to creeping discharge caused by applying an alternating voltage across the discharge electrode and the induction electrode, the induction electrode being provided in an insulating base material, a heater electrode, provided on the insulating base material, which generates, in response to electric power being supplied, Joule heat for causing the ion generating device to be heated, the heater electrode being wired so as to heat (i) a creeping discharge area where the creeping discharge occurs and (ii) areas where respective terminal sections of the induction electrode, the discharge electrode, and the heater electrode are provided.

2. The ion generating device as set forth in claim 1, wherein the heater electrode is arranged so that a temperature difference between the creeping discharge area and the respective areas where the respective terminal sections are provided falls within 10° C.

3. The ion generating device as set forth in claim wherein the heater electrode is provided, so as to have a line-shaped pattern, on a surface of the insulating base material on which surface the induction electrode is provided.

4. The ion generating device as set forth in claim 1, wherein the heater electrode is provided, so as to have a solid shape, on a surface of the insulating base material which surface is opposite to a surface where the induction electrode is provided.

5. The ion generating device as set forth in claim 1, wherein the induction electrode and the heater electrode are electrically insulated from each other.

6. The ion generating device as set forth in claim 1, wherein the terminal section of the discharge electrode is made of an electrically conductive material which is mainly composed of gold or platinum.

7. The ion generating device as set forth in claim 1, wherein each of the induction electrode and the heater electrode is made of an electrically conductive material which is mainly composed of silver, copper, or nickel.

8. A charging device comprising:

an ion generating device recited in claim 1;

a power supply section for applying the alternating current across the discharge electrode and the induction electrode; and a heater power supply section for supplying the electric power to the heater electrode.

9. An image forming apparatus comprising:

a transfer receiving body;

a bearing member for bearing a toner image transferred to the transfer receiving body; and a charging device for charging before a transfer, the charging device for charging before a transfer being a charging device recited in claim 8.

10. An image forming apparatus comprising:

an electrostatic latent image bearing member; and a charging device for charging the electrostatic latent image bearing member, the charging device being a charging device recited in claim 8.

* * * * *